US010947691B2

(12) United States Patent
Woolbright

(10) Patent No.: US 10,947,691 B2
(45) **Date of Patent: *Mar. 16, 2021**

(54) RETAINING WALL SYSTEM

(71) Applicant: ERS Materials, LLC, Woodstock, GA (US)

(72) Inventor: Mark Woolbright, St. Louis, MO (US)

(73) Assignee: ERS Materials, LLC, Woodstock, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/776,066

(22) Filed: Jan. 29, 2020

(65) Prior Publication Data

US 2020/0232178 A1 Jul. 23, 2020

Related U.S. Application Data

(63) Continuation of application No. 16/179,249, filed on Nov. 2, 2018, now Pat. No. 10,584,461.

(51) Int. Cl.
*E02D 29/02* (2006.01)

(52) U.S. Cl.
CPC .. *E02D 29/0266* (2013.01); *E02D 2200/1642* (2013.01); *E02D 2250/0007* (2013.01); *E02D 2300/001* (2013.01); *E02D 2600/20* (2013.01); *E02D 2600/40* (2013.01)

(58) Field of Classification Search
CPC ..... A01G 9/022; A01G 9/023; E04C 1/395; E02D 17/20; E02D 17/202; E02D 17/205; E02D 29/02; E02D 29/0225; E02D 29/0233; E02D 29/0241; E02D 29/0226
USPC ..... 405/262, 284–287
See application file for complete search history.

(56) References Cited

U.S. PATENT DOCUMENTS

| | | | | |
|---|---|---|---|---|
| 4,060,946 | A | 12/1977 | Lang et al. | |
| 6,238,144 | B1 | 5/2001 | Babcock | |
| 10,584,461 | B1 * | 3/2020 | Woolbright | E02D 29/0266 |
| 2007/0224021 | A1 | 9/2007 | Travi | |
| 2016/0362890 | A1 | 12/2016 | Burke | |
| 2019/0037778 | A1 * | 2/2019 | Duncan | A01G 9/025 |

FOREIGN PATENT DOCUMENTS

DE 9318930 U1 3/1994

* cited by examiner

*Primary Examiner* — Sunil Singh
(74) *Attorney, Agent, or Firm* — Armstrong Teasdale LLP

(57) ABSTRACT

A retaining wall system includes a face panel having a first end beam and a second end beam extending in parallel to the first end beam. The face panel extends a height defined from the first end beam to the second end beam when the face panel is oriented in an upright position. The face panel further includes a backfill side and is configured to retain a backfill material on the backfill side of the face panel. The retaining wall system further includes a support leg having a bracket for receiving the first end beam therein and an extension platform transversely oriented to the height of the face panel when the first end beam is received within the bracket. The extension platform extends away from the bracket and is configured to anchor the face panel in the upright position.

19 Claims, 23 Drawing Sheets

RETAINING WALL SYSTEM

CROSS REFERENCE TO RELATED APPLICATION

This application is a continuation of U.S. patent application Ser. No. 16/179,249, filed Nov. 2, 2018, the entire contents of which are incorporated herein.

BACKGROUND

The present invention relates generally to retaining wall systems and more particularly to retaining wall systems configured to serve as a compaction form and positioning aid for backfill material.

Typically, retaining wall systems include upright panel portions and leg portions at a transverse angle with the upright portions. For example, some conventional retaining wall systems are formed from sheets of welded wire panels that are bent in half at a right angle to form a bottom leg portion and an upright face portion. The bottom leg portion of the wire welded panel is typically placed horizontally on a compacted backfill material such that the upright face portion is at an upright angle. Backfill material is then laid on top of the bottom leg portion to anchor the panels.

However, compacting backfill material on these retaining wall systems can lead to deflection in the upright portions. Accordingly, some conventional retaining wall systems also include struts extending at a forty-five degree angle from the tops of the upright portion of the panels to distal regions of the leg portions to prevent the backfill material from causing deflection of the upright portion. However, these struts can create obstacles in the placement and compaction of backfill material on the bottom leg of the panels. For example, an operator compacting backfill material in such conventional systems must navigate around the struts extending at an angle to the leg portions. Accordingly, more time and labor is required to adequately compact the backfill material and, moreover, some backfill material may even be so obstructed by the struts that the operator is unable to sufficiently compact it at all. Furthermore, the conventional wire panels are typically formed of steel that is either allowed to corrode or protected by a zinc or epoxy coating. Steel and its protective coatings are generally costly and subject to significant price volatility.

Therefore, there is a need for an inexpensive retaining wall system that inhibits deflection of the face panels without obstructing the backfill material laid for compaction and provides better long-term durability performance.

SUMMARY

In one embodiment, a retaining wall system generally comprises a face panel having a first end beam and a second end beam extending in parallel to the first end beam. The face panel extends a height defined from the first end beam to the second end beam when the face panel is oriented in an upright position. The face panel further includes a backfill side and is configured to retain a backfill material on the backfill side of the face panel. The retaining wall system further comprises a support leg having a bracket for receiving the first end beam therein and an extension platform transversely oriented to the height of the face panel when the first end beam is received within the bracket. The extension platform extends away from the bracket and is configured to anchor the face panel in the upright position.

In another embodiment, a retaining wall system generally comprises a face panel including a first end beam and a second end beam at a free distal end of the face panel. The second end beam extends in parallel to the first end beam. The retaining wall system further comprises a support leg selectively attachable to the first end beam and extending in transverse orientation to the first and second end beams. The support leg is configured to support the face panel such that the second end beam is maintained in substantially parallel orientation with the first end beam.

In yet another embodiment, a method of assembling a retaining wall generally comprises providing a face panel including a first end beam and a second end beam extending in parallel to the first end beam. The method further comprises attaching the first end beam of the face panel to a support leg, including an extension beam, such that the face panel extends a height from the first end beam to the second end beam. The method further comprises positioning the extension platform in a backfill region and providing a backfill material on top of the extension platform to extend the height of the face panel such that the face panel retains the backfill material in the backfill region.

BRIEF DESCRIPTION

Figure 19:
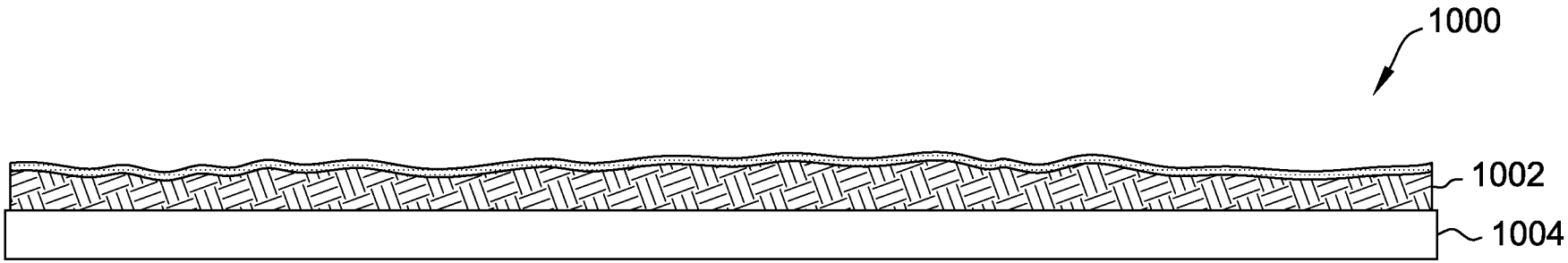
FIG. 19 illustrates a first state of a process of preparing the base of a retaining wall in accordance with the retaining wall system of FIG. 1, in which a relatively flat ground surface is provided.
Figure 23:
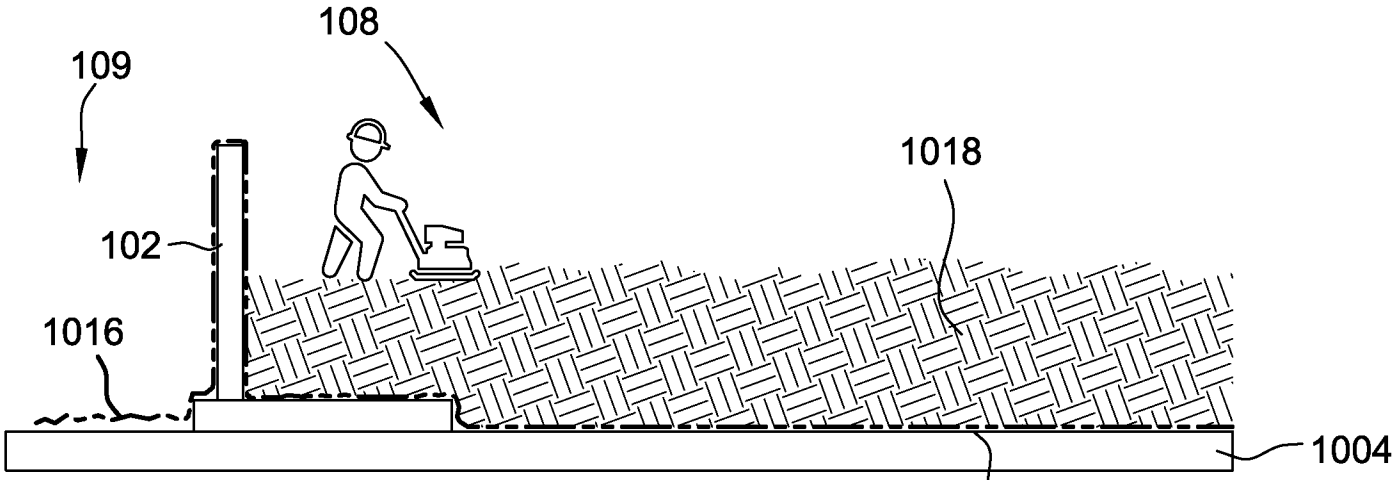
Figure 24:
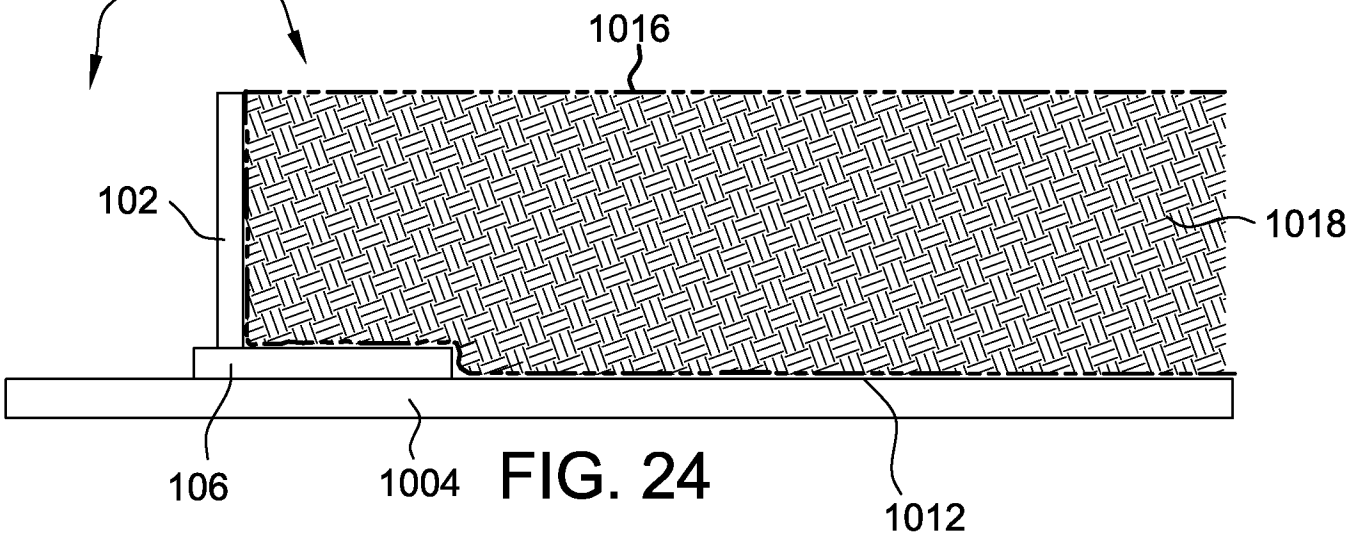
Figure 25:
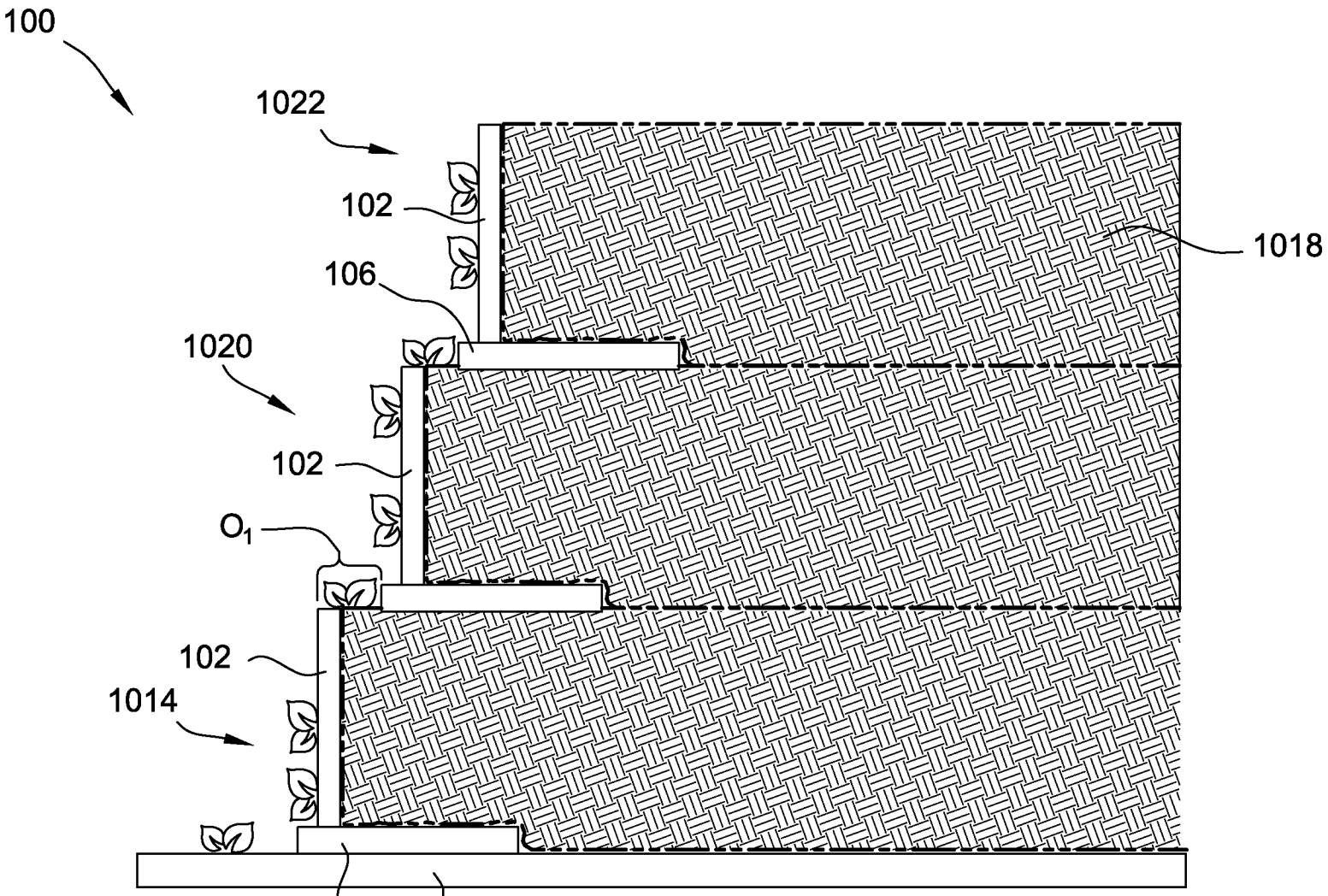

FIG. 23 includes a fifth state of the process of FIG. 19, wherein a backfill material is provided for compaction;

FIG. 24 includes a sixth state of the process of FIG. 19, wherein the compacted backfill extends to the top of the face panel; and FIG. 25 includes a seventh state of the process of FIG. 19, wherein the process is repeated with additional vertically stacked layers of face panels and backfill.

Corresponding reference characters indicate corresponding parts throughout the several views of the drawings.

DETAILED DESCRIPTION

Figure 1:
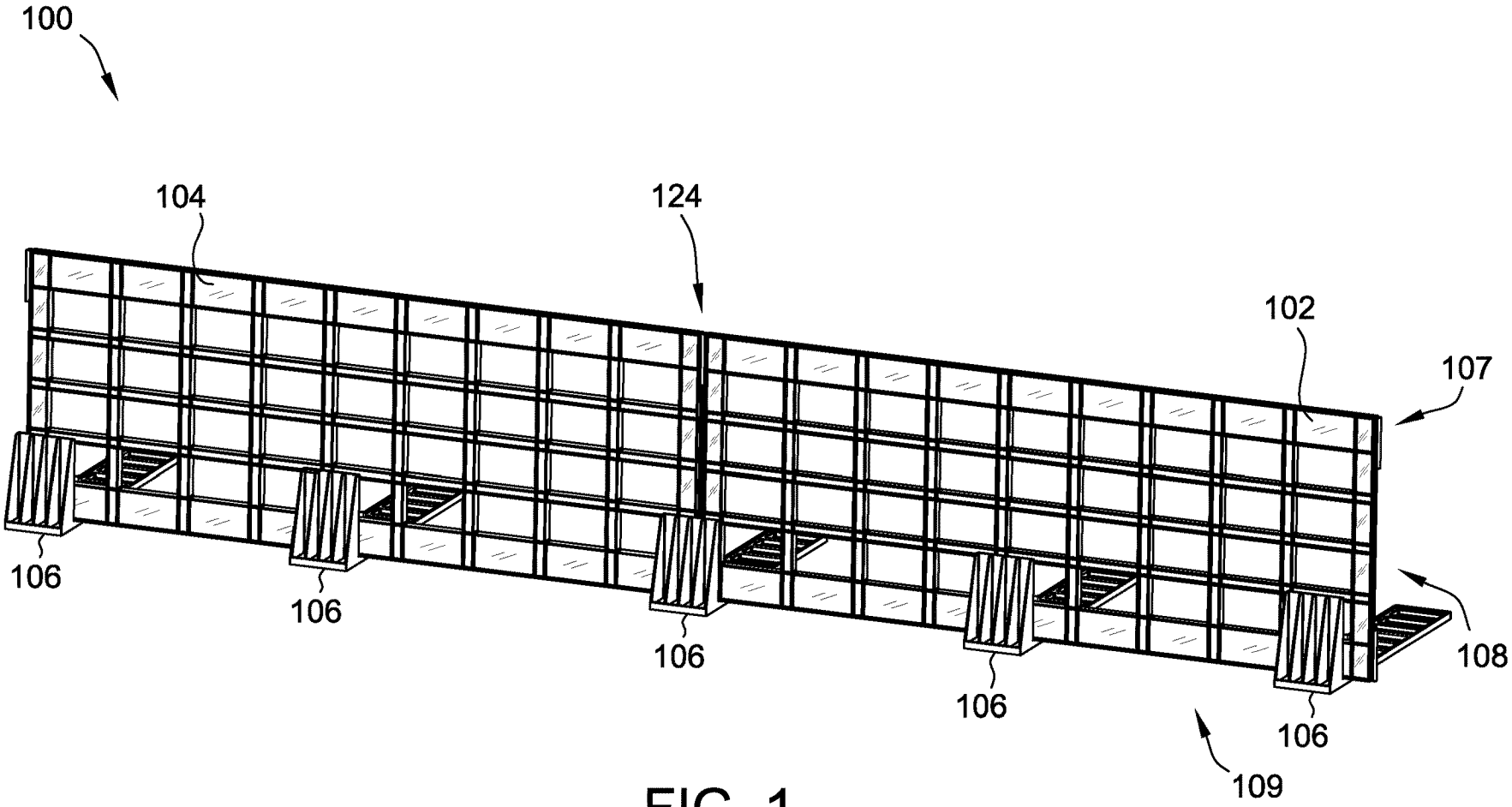
FIG. 1 is a perspective view of one suitable embodiment of a retaining wall system of the present disclosure.
Figure 2:
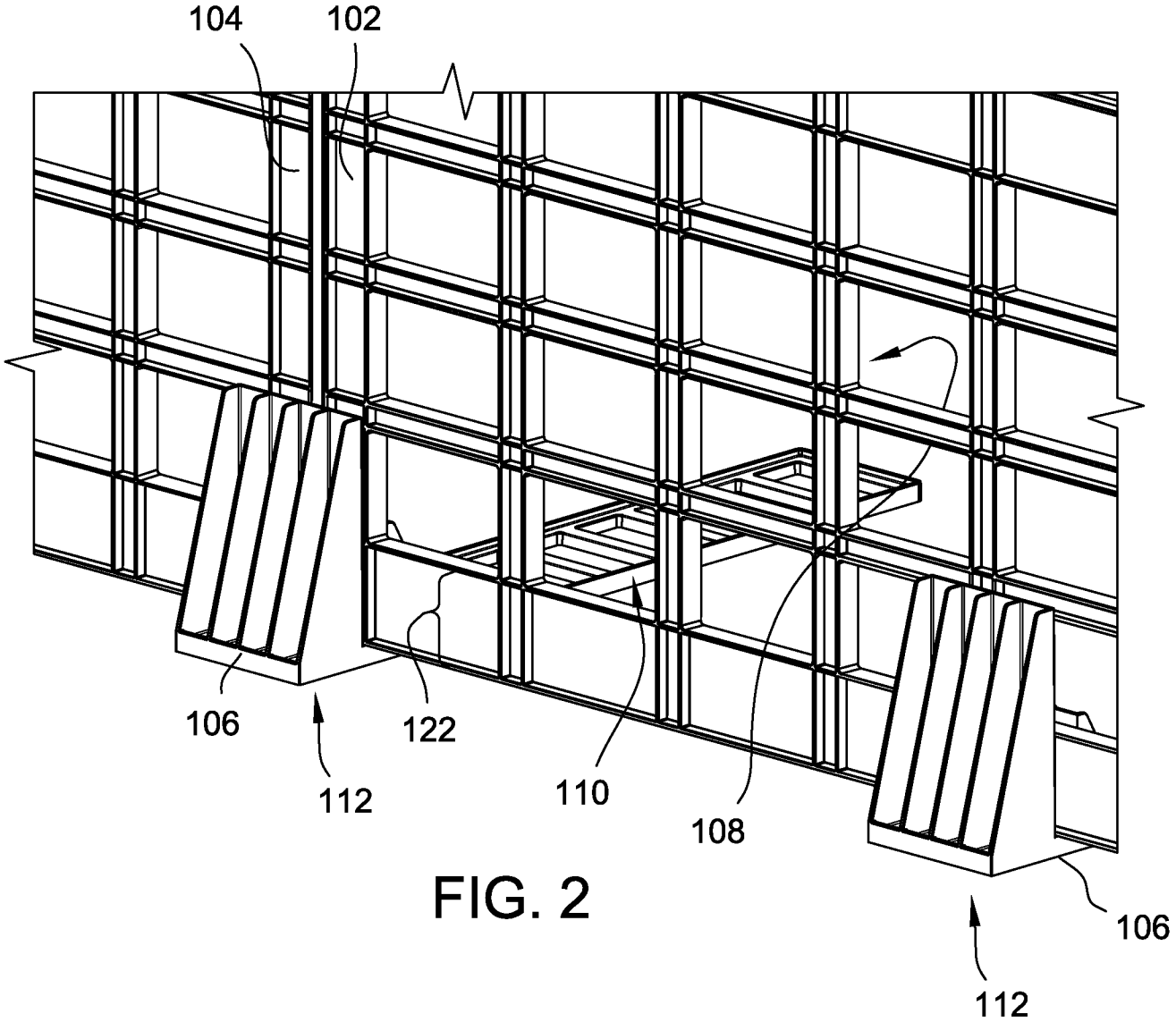
FIG. 2 is an enlarged, perspective view of a portion of the retaining wall system of FIG. 1.
Figure 3:
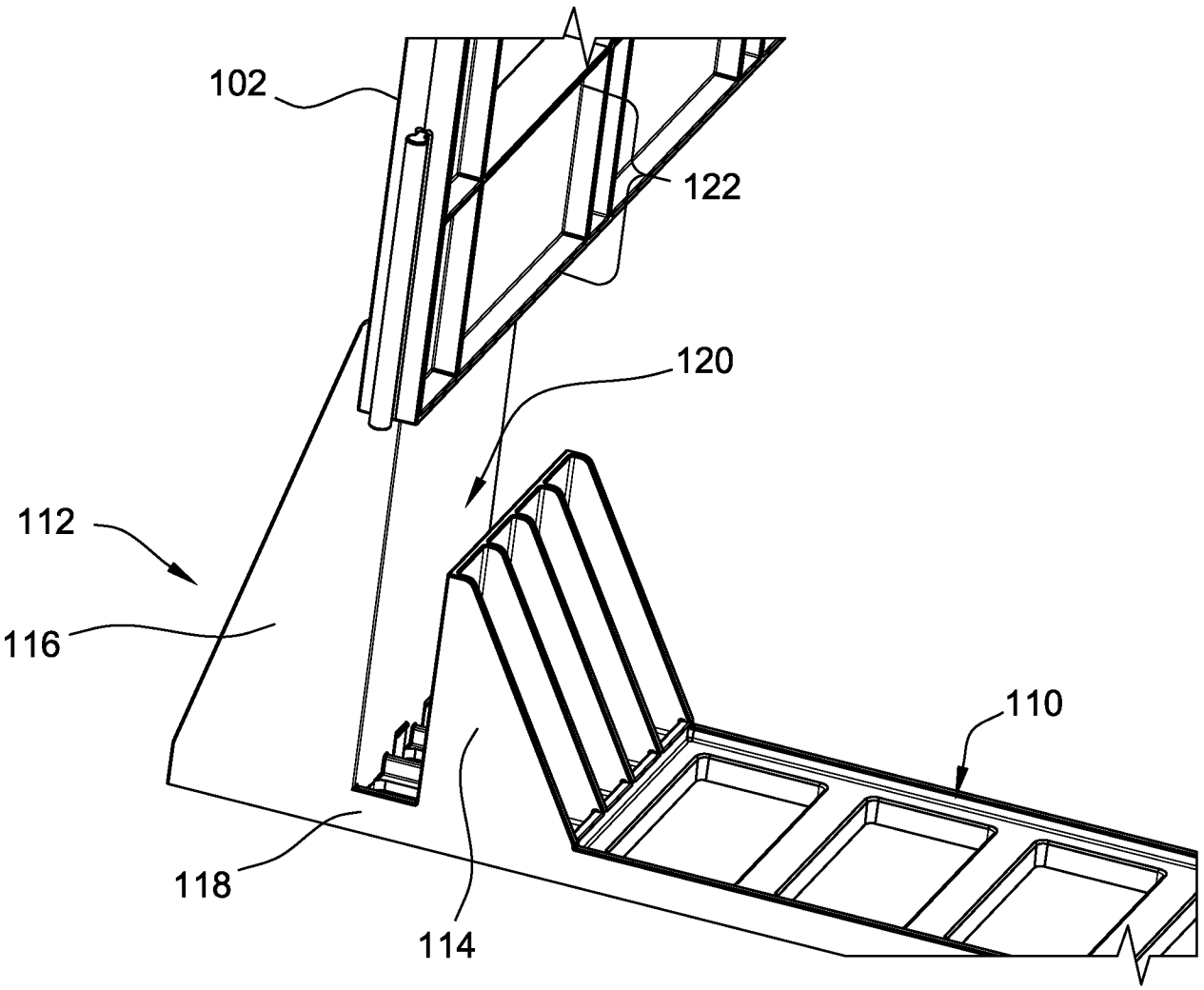
FIG. 3 is an enlarged, perspective view of a portion the retaining wall system of FIG. 1 illustrating a face panel being inserted to a support leg.
Figure 4:
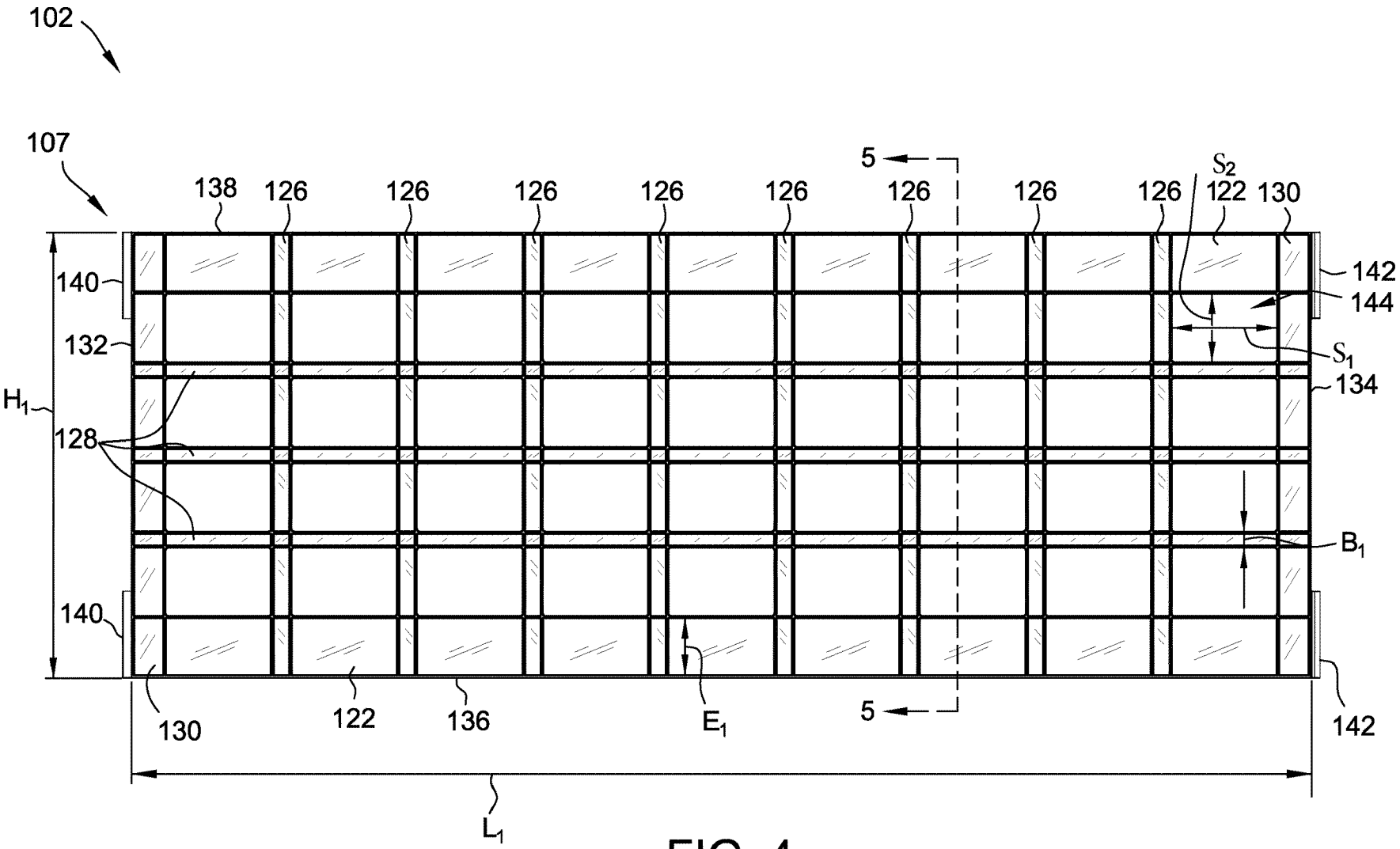
FIG. 4 is a front view of a face panel of the retaining wall system of FIG. 1.

Referring now to the drawings and in particular to FIGS. 1-3, a retaining wall system according to one suitable embodiment of the present disclosure is indicated generally by the reference numeral 100. It is understood, however, that other suitable embodiments of the retaining wall system 100 are also contemplated without departing from the scope of this disclosure.

The illustrated retaining wall system 100 comprises a first face panel indicated at 102 connected to a second face panel indicated at 104. In other suitable embodiments, the retaining wall system 100 may include any number of face panels that enables the retaining wall system 100 to operate as described herein. For example, in some embodiments, the retaining wall system 100 includes only one face panel. In other suitable embodiments, the retaining wall system 100 can include any suitable number of first and second face panels 102, 104. The retaining wall system 100, as seen in FIG. 1-3, further comprises a plurality of support legs, generally indicated at 106.

The retaining wall system 100 is configured to serve as a compaction form and positioning aid for the placement of reinforcement elements compacted within engineered backfill such as, but not limited to, crushed rock, gravel, sand, or soil. In particular, the retaining wall system 100 is configured to maintain compacted backfill (not shown) on a backfill side, generally indicated at 108, of the retaining wall system 100 by inhibiting the movement of backfill through the face panels 102, 104 to a front side, generally indicated at 109, of the retaining wall system 100. In other embodiments, the retaining wall system 100 comprises a geogrid (not shown), lining the face panels 102, 104 and the support legs 106 to inhibit movement of the backfill material through openings, generally indicated at 144, in the face panels 102, 104 and to provide structural reinforcement to the face panels 102, 104.

In the illustrated embodiment, the face panels 102, 104 are received in and supported by the plurality of support legs 106. That is, the face panels 102, 104 are removably attached to support legs 106. In other embodiments, the face panels 102, 104 may be connected to the support legs 106 in any manner that enables the retaining wall system 100 to function as described herein. For example, and not by way of limitation, in other embodiments the face panel 102 and support legs 106 may formed as a single continuous piece.

In the illustrated embodiment, the face panels 102, 104 and support legs 106 are attached to one another in an "L" formation. The support legs 106 are configured for placement on the surface of soil or a compacted backfill. The support legs 106 each comprise an extension platform 110 and a bracket 112. The extension platform 110 extends into the backfill region 108 of the retaining wall system 100. The support legs 106 provide support for the face panels 102, 104 to inhibit warping of the face panels 102, 104 or movement of the face panels 102, 104 under pressure from the backfill. More specifically, the support legs 106 provide sufficient support to the retaining wall system 100 to enable the retaining wall system 100 to maintain an upright position on top of compacted backfill and withstand movement caused by the laying in of structural geogrids and placement and compaction of backfill material.

The bracket 112 facilitates connecting the face panels 102, 104 to the extension platform 110 of the support leg 106. Specifically, with reference to FIG. 3, the brackets 112 each include a rear support 114 and a front support 116. A base 118 of the support leg 106 extends along the extension platform 110 and connects the front support 116 to the rear support 114. The front support 116 and the rear support 114 extend vertically away from the base 118 and are spaced from one another to define a slot 120 therebetween for receiving at least a portion of one of the face panels 102, 104. In other embodiments, the front support 116 and/or the rear support 114 may extend vertically at any angle with respect to the base that enables the retaining wall system 100 to function as described herein.

The slots 120 in the support leg 106 are sized in correspondence with end beams 122 of the face panels 102, 104 to allow for removably attaching the face panels 102, 104 to the support legs by sliding an end beam 122 of the face panel 102 into the slot 120 of the bracket 112. In particular, in the illustrated embodiment, the rear support 114 and the front support 116 are sized to extend to a height at least above the end beam 122 of the face panel 102 such that the end beam 122 is received entirely within the slot 120. Referring to FIG. 2, the brackets 112 are further sized to tightly engage the face panel 102 such that the face panel 102 is maintained in an upright position whereby deflection of the face panel 102 with respect to the support leg 106 is inhibited. For example, in the illustrated embodiment, the brackets 112 engage the face panel at the end beams 122 such that resistance is created between the face panel 102 and the support leg 106. In other embodiments, the brackets 112 may engage any portion of the face panel 102 that enables the retaining wall system 100 to function as described herein. In yet other embodiments, the brackets 112 may include an adjustment mechanism (not shown) for adjusting the size of the defined slot 120. For example, the adjustment mechanism may allow for movement of the rear support 114 of the bracket 112 relative to the front support 116.

With reference back to FIG. 1, in the illustrated embodiment, the face panels 102, 104 and the support legs 106 of the retaining wall system 100 are modular such that they are configured to link to any number of face panels and be supported by any number of support legs as required for a particular retaining wall system 100. For example, and without limitation, in the illustrated embodiment, the first face panel 102 is at least partially received within three support legs 106. Further, the first face panel 102 is connected to the second face panel 104, both of which are received within a support leg 106 at a connection point, generally indicated at 124 between the first face panel 102 and the second face panel 104. In other embodiments, the support legs 106 are evenly spaced along the face panels 102, 104 of the retaining wall system 100 to provide evenly distributed support to the face panels 102, 104 facing evenly distributed backfill loads. In contrast, in other embodiments, a load applied by backfill material or the ground conditions may be uneven across the retaining wall system 100. Accordingly, in such embodiments, the retaining wall system 100 may require additional support legs 106 along certain portions of the retaining wall system 100 subjected to higher loads or less stable ground conditions, resulting in unevenly distributed support legs 106.

The illustrated face panels 102, 104 and support legs 106 are made of an injection molded plastic. In particular, the face panels 102, 104 and support legs 106 are made of a formulation of polypropylene. In other embodiments, the face panels 102, 104 and the support legs 106 are made of a homopolymer or a homopolymer/polypropylene blend. In further embodiments, the face panels 102, 104 and the support legs 106 include a variety of additives to increase durability, UV resistance, flexural capacity, rigidity, etc. In yet other embodiments, the face panels 102, 104 may be formed any polymeric material that enables the retaining wall system 100 to operate as described herein. For example, and not by way of limitation, other suitable polymers include polyurethane, nylon, polyethylene. In other embodiments, the face panels 102, 104 may be formed of fiber glass, wood, stamped metal, or a high strength fiber reinforced plastics such as carbon fiber. In yet other embodiments, the face panels 102, 104 and support legs may be made of any material that enables the retaining wall system 100 to operate as described herein.

With reference to FIGS. 4-8B, the illustrated face panel 102 comprises a plurality of vertically extending beams 126 and a plurality of horizontally extending beams 128 arranged to intersect one another in a grid formation. The face panel 102 further comprises a pair of end beams 122 defining an upper and lower extent of the face panel 102 and a pair of side beams 130 defining a horizontal extent of the face panel 102. The face panel 102 is configured to be received within the support leg 106 (shown in FIGS. 1-3) at an end beam 122 of the face panel 102 with the other end beam 122 located at a free distal end, generally indicated at 107, of the face panel 102.

The face panel 102 has a length $L_1$ defined between a first side beam surface 132 and a second side beam surface 134. The face panel further has a height $H_1$ defined between a first end beam surface 136 and a second end beam surface 138. In the illustrated embodiment, the length $L_1$ of the face panel 102 is 48 inches and the height $H_1$ of the face panel 102 is 17.988 inches. In other embodiments, the face panel 102 may have any height $H_1$ and length $L_1$ that enables the retaining wall system 100 to function as described herein.

The end beams 122 are each located at opposite ends of the height $H_1$ of the face panel 102 and each extend along the length $L_1$ of the face panel 102. The end beams 122 are configured to be received within the slot 120 of the support leg 106, as described above with respect to FIGS. 1-3. Accordingly, in the illustrated embodiment, the end beams 122 are sized to have a height $E_1$ greater than a height $B_1$ of the horizontally extending beams 128 to provide a greater surface area for engagement between the end beams 122 and the slot 120. Moreover, both end beams 122 of the illustrated face panel 102 have the same height $E_1$. Accordingly, the illustrated face panel 102 may be positioned within the slot 120 of the support leg 106 at either end beam 122. In the illustrated embodiment, the height $E_1$ of the end beams 122 is 2.504 inches. In other embodiments, the end beams 122 may have any height $E_1$ that enables the end beams 122 to function as described herein.

The side beams 130 are located at opposite ends of the length $L_1$ of the face panel 102 and each extend along the height $H_1$ of the face panel 102. As described in further detail below with respect to FIGS. 7A-8B, the side beams 130 each include a set of connection members 140, 142 positioned respectively on a first side beam surface 132 and a second side beam surface 134. The connection members 140, 142 are configured to facilitate removably coupling the face panel 102 to an additional face panel 102 to extend the total length of the retaining wall system 100. In particular, in the illustrated embodiment, the first end beam surface 132 is an engagement end of the face panel 102 and the second end beam surface 134 is a receiving end of the face panel 102. Accordingly, the side beams 130 are sized to support a stable connection between the face panel 102 and the second face panel 104 (as shown in FIG. 1).

In the illustrated embodiment, the horizontally extending beams 128 are each evenly spaced a vertical distance $S_1$ from the adjacent horizontally extending beams 128. Further, the vertically extending beams 126 are each evenly spaced a horizontal distance $S_2$ from the adjacent vertically extending beams 126. In the illustrated embodiment, the vertically extending beams 126 are spaced a greater distance from one another than the horizontally extending beams 128 are spaced from one another such that $S_2$ is greater than $S_1$. In particular, the beams 126, 128 are spaced such that openings 144, defined between the vertically extending beams 126 and the horizontally extending beams 128, are rectangular shaped. In the illustrated embodiment, openings 144 include a height $S_1$ of 2.731 inches and a length $S_2$ of 4.231 inches. In other embodiments, horizontally extending 128 beams may be spaced greater from one another than vertically extending beams 126. In yet other embodiments, the beams 126, 128 are spaced such that the openings 144 are square. In even further embodiments, the beams the beams 126, 128 are spaced such that the openings 144 have any shape that enables the retaining wall system 100 to function as described herein.

Figure 5:
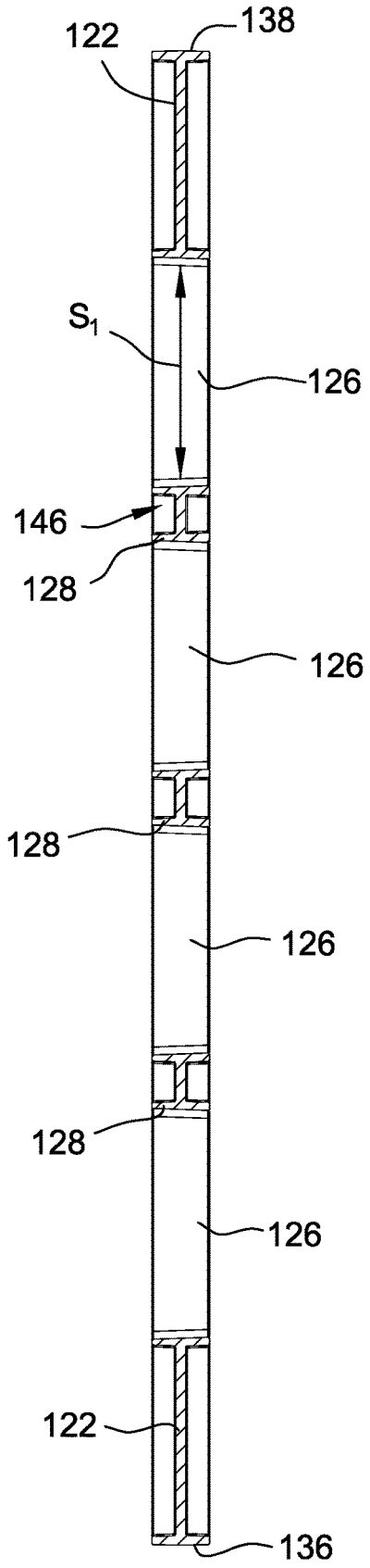
FIG. 5 is a cross sectional side view of the face panel of FIG. 4 taken along the plane 5-5.
Figure 6:
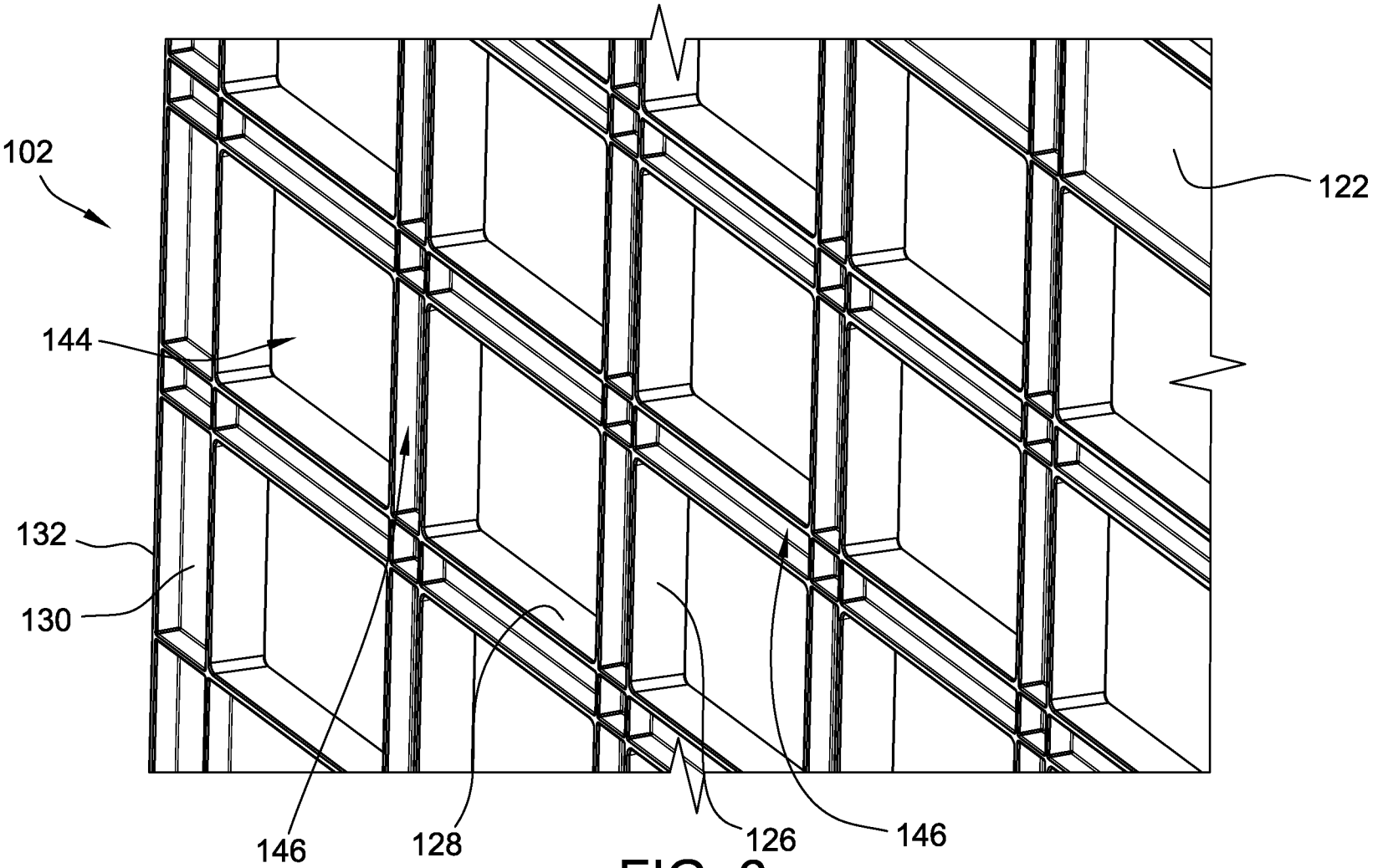
FIG. 6 is an enlarged perspective view of a portion of the face panel of FIG. 4.

With reference to FIGS. 5 and 6, the vertically extending beams 126 and the horizontally extending beams 128 are "I-beams". That is, the vertically extending beams 126 and the horizontally extending beams 128 of the illustrated embodiment are both shaped to have an "I" shaped cross section. In the illustrated embodiment, the horizontally extending beams 128 are oriented at an incline to facilitate the flow or water and/or loose soil through the openings 144 from the front side 109 to the backfill side 108. In other embodiments, the vertically end beams 122 may include tabs (not shown) molded on the face panel 102 to hook into a geogrid that positioned along the face during construction to prevent loose movement of the geogrid during construction. In particular, the beams 126, 128 define recesses in the I-cross section, indicated generally at 146.

The arrangement of vertically extending beams 126 and horizontally extending beams 128 provides rigidity within the face panel 102 while facilitating the trapping of soil, seed, hydromulch material, and other fertilizing materials within the face panel 102. In particular, the arrangement of recesses 146 and openings 144 in the face panel 102 allows for fertilizing materials to be supported by and within the face panel 102 of the retaining wall system. Further, openings 144 facilitate plant growth from the backfill side 108 extending through the face panel 102 to the front side 109. Accordingly, the illustrated face panel 102 allows for germination and rooting-in of vegetative plant materials on the face panel 102 of the retaining wall system 100. In other embodiments, filter fabrics (not shown) may be affixed to the face panel 102 or attached to the face panel 102 to facilitate landscape applications without requiring installation of a separate geogrid on the face panel 102.

Figure 7A:
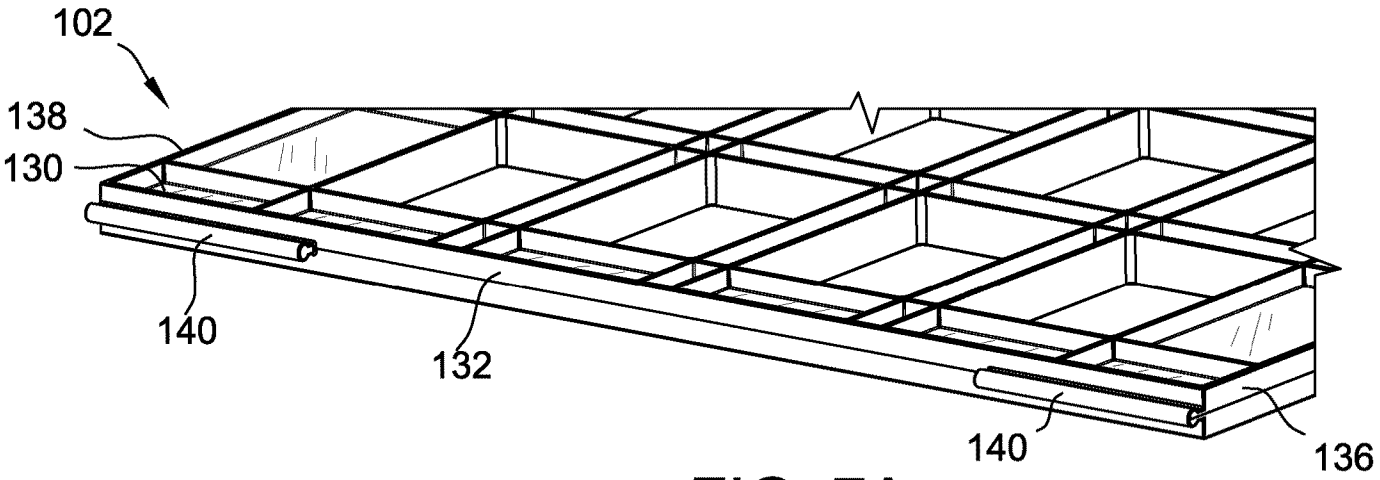
FIG. 7A is an enlarged, perspective view of a first side beam engagement end of the face panel of FIG. 4.
Figure 7B:
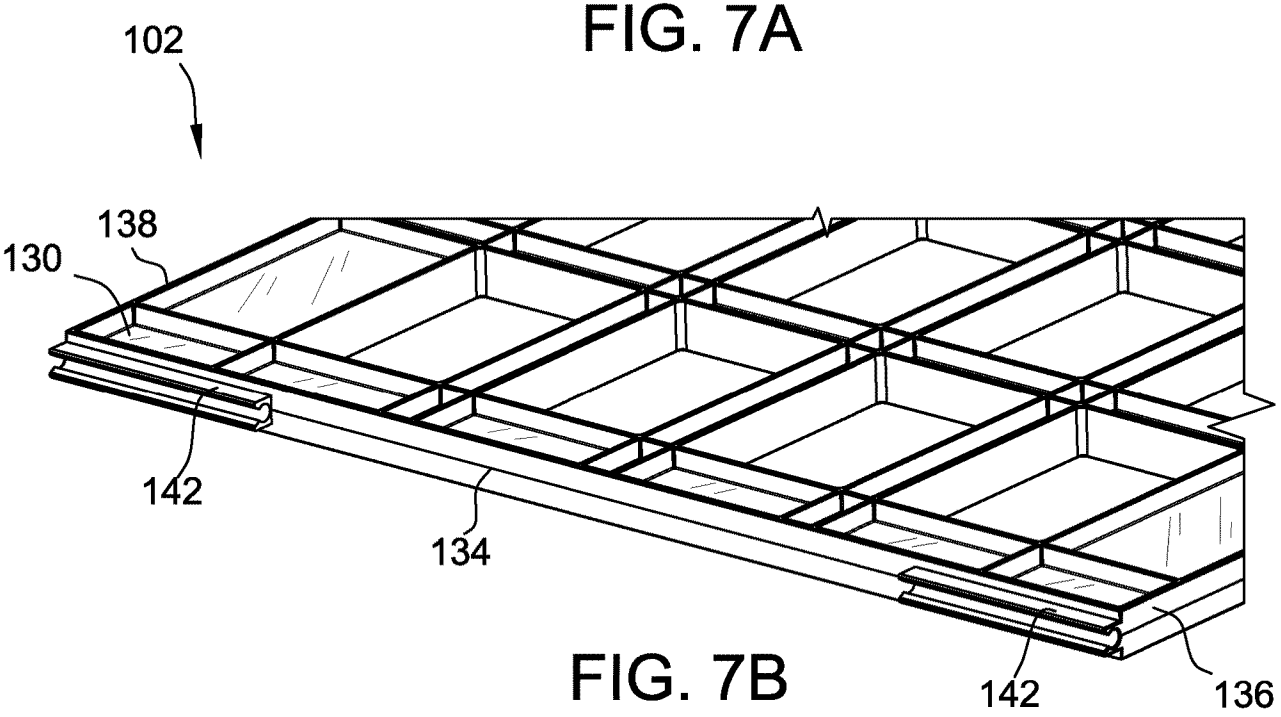
FIG. 7B is an enlarged, perspective view of a second side beam receiving end of the face panel of FIG. 4.

As best seen in FIGS. 7A and 7B, the illustrated face panel 102 includes two first connection members 140 positioned on the first side beam sidewall 132 and two second connection members 142 positioned on the second side beam sidewall 134. In particular, each set of connection members 140, 142 includes a connection member 140, 142 located adjacent the first end beam surface 138 and an additional connection member 140, 142 located adjacent the second end beam surface 136. In other embodiments, the face panel 102 may include any number of connection members 140, 142 that enables the face panel 102 to operate as described herein. For example, and not by way of limitation, in other embodiments each set of connection members 140, 142 may include a third connection members (not shown) with the third connection member located intermediate the other two connection members 140, 142 along the height of the respective end beam sidewalls 132, 134. In yet other embodiments, each set of connection members 140, 142 may extend the entire lengths of the respective first side beam sidewall 132 and second side beam sidewall 134.

The connection members 140, 142 each extend outwardly from the respective sidewalls 132, 134 in the lengthwise direction to facilitate removable attachment to a corresponding connection member 140, 142 of an adjacent face panel. In particular, the connection members 140 are sized and shaped in relation to one another to facilitate releasable engagement with the corresponding connection members 140, 142 of an adjacent face panel. For example, in the illustrated embodiment, the first connection members 140 are plug shaped and sized to be received within a recess defined by the second connection members 142.

Figure 8A:
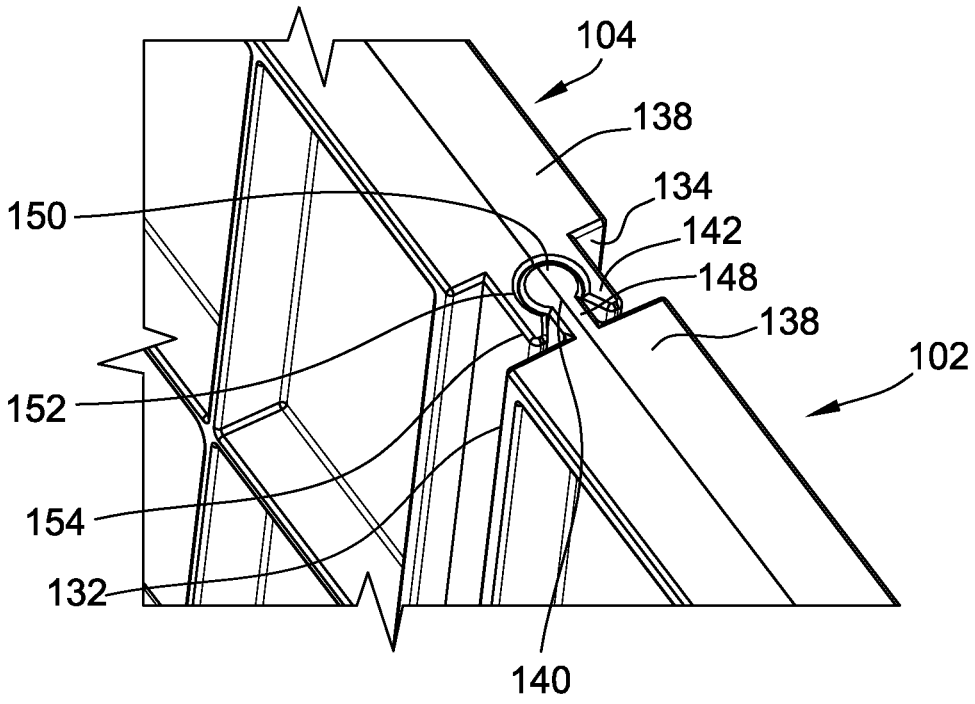
FIG. 8A is an enlarged, perspective view of the retaining wall system of FIG. 1 illustrating the first side beam engagement end of the first face panel engaged in a first position with the second side beam receiving end of the second face panel.

Referring to FIG. 8A, the first face panel 102 is illustrated in connection with second face panel 104. As shown in the illustrated embodiment, the first connection member 140 is received and secured within the second connection member 142. The illustrated connection members 140, 142 are each molded onto the first and second side beam surfaces 132, 134 of the face panel 102. In other embodiments however, the connection members 140, 142 may be removably attached to the first and second side beam surfaces 132, 134 of the face panel 102 to facilitate including alternative connecting members on the face panel 102. Further, in other embodiments, a connecting member (not shown) may be attached to a separate surface of the side beam 130 to facilitate connecting an additional face panel at a transverse orientation to the first face panel 102 to form a corner in the retaining wall system 100.

The first connection member 140 and the second connection member 142 are attached via a torsional snap fit connection. In particular, the illustrated first connection member 140 includes a neck 148 extending from the first side beam surface 132 in the lengthwise direction to a head 150. The second connection member 142 extends outwardly in the lengthwise direction from the second end beam sidewall 134 and includes and angled locking portion 154 and an annular inner sidewall 152. The second connection member 142 is composed of a resiliently flexible material such that, during connection of the second face panel 104 to the first face panel 102, the angled locking portions 154 of the second connection member 142 engage the head 150 of the first connection member 140 and are thereby caused to flex outwardly from the head 150 to allow the head 150 to be received within the annular inner sidewall 152 of the second connection member 142. As the head 150 is inserted further within the annular inner side 152 of the second connection member 140, the angled locking portions 154 flex inward towards the neck 148 of the first connection member 140, thereby locking the head 150 within the annular inner sidewall 152 of the second connection member 142.

Figure 8B:
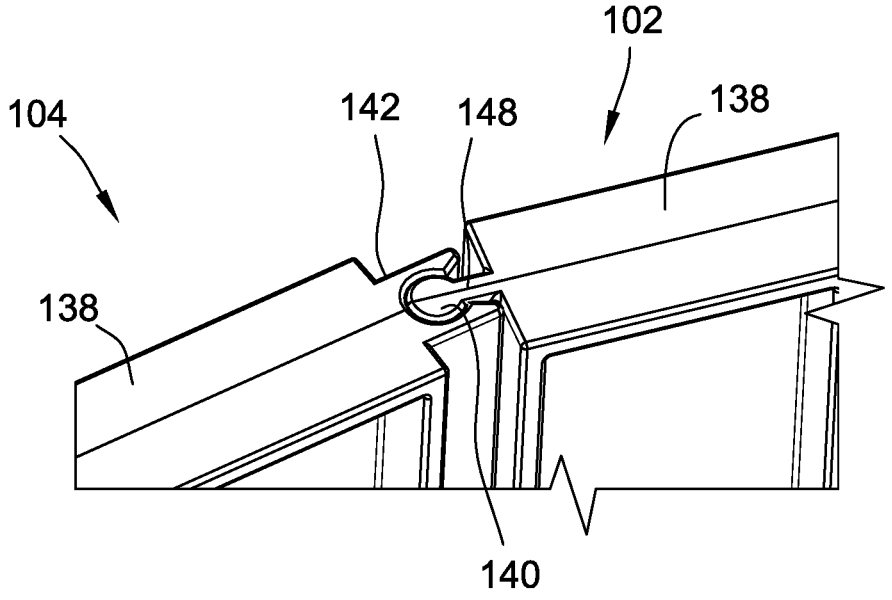
FIG. 8B is an enlarged, perspective view illustrating the first face panel and the second face panel of FIG. 8A connected in a second position.

Referring to FIG. 8B, the torsional snap fit connection between the first connection member 140 and the second connection member 142 allows for orienting the second face panel 104 out of line with the length wise direction of the first face panel 102. Accordingly, multiple face panels may be coupled to one another at an angle with one another to facilitate providing a curvature in the retaining wall system along the cumulative length of the connected panels.

With reference to FIGS. 9-12, the illustrated support leg 106 extends a length $D_1$ from the front section 116 of the bracket 112 to a rear end 155 of the extension platform 110. The support leg 106 is configured to have backfill material loaded onto the extension platform 110 of the support leg 106. In particular, the extension platform 110 comprises two leg struts 156, 158 extending along the base 118 in the lengthwise direction of the support leg 106 and in transverse orientation to the slot 120 of the bracket 112. The leg struts 156, 158 are transversely spaced from one another a distance, generally indicated at $D_2$. The leg struts 156, 158 are also connected by a plurality of step bars 160 such that the extension platform 110 is configured in a "ladder" formation. The step bars 160 are transversely spaced from one another a distance, generally indicated at $D_3$. The step bars 160 define openings in the extension platform 110 between one another, generally indicated at 162. The openings 162 defined in the step bar facilitate loading backfill material within the extension platform 110. That is, the openings 162 enable the added backfill material to be adjacent the already laid compacted backfill material that the support leg 106 is placed on. Accordingly, the openings 162 allow for backfill material to be compacted within and through the extension platform 110, allowing for added anchoring the support leg 106 within the backfill material. In the illustrated embodiment, $D_1$ is 21 inches, $D_2$ is 3.175 inches and $D_3$ is 1.475 inches. In other embodiments, the support leg is sized in any manner that enables the retaining wall system to function as described herein.

Figure 10:
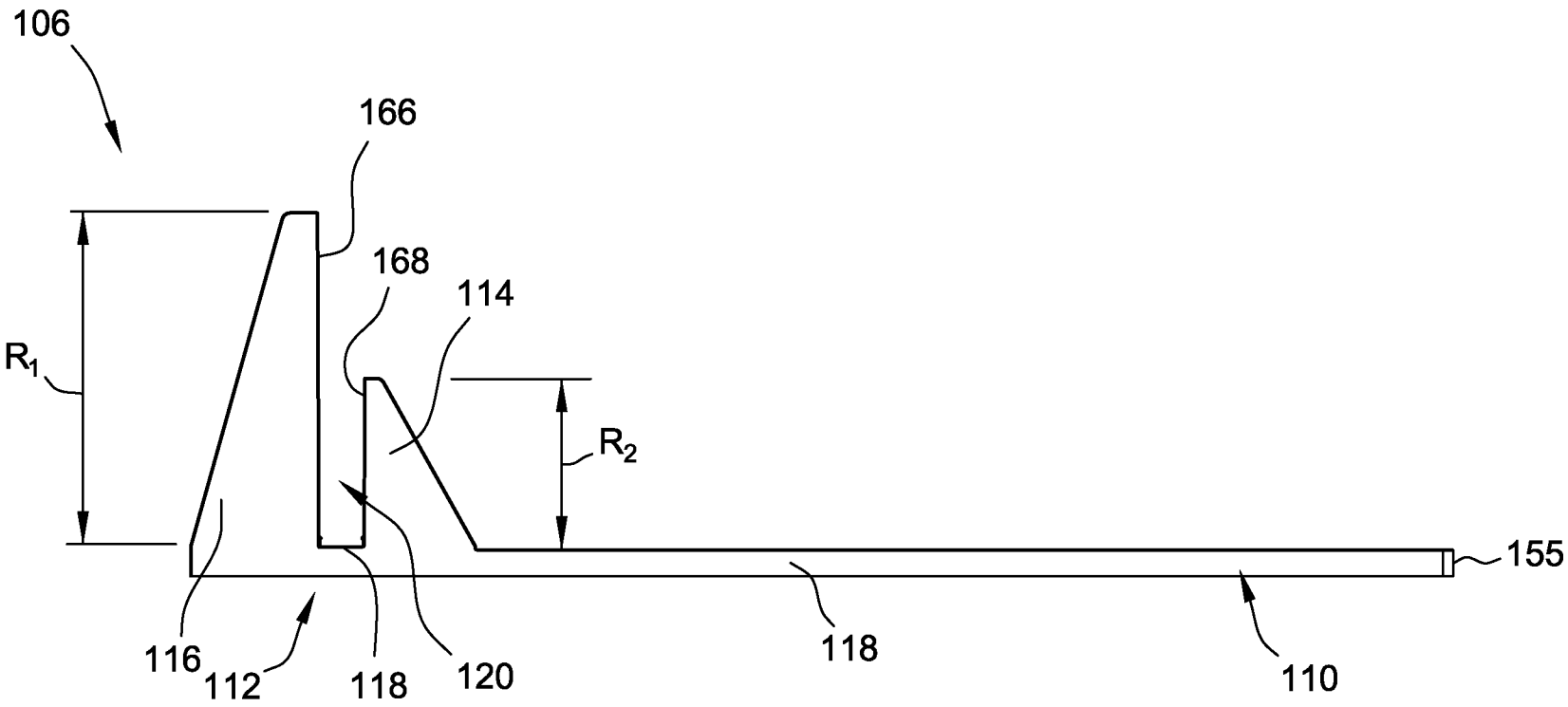
FIG. 10 is a side view of the support leg of FIG. 9.
Figure 11:
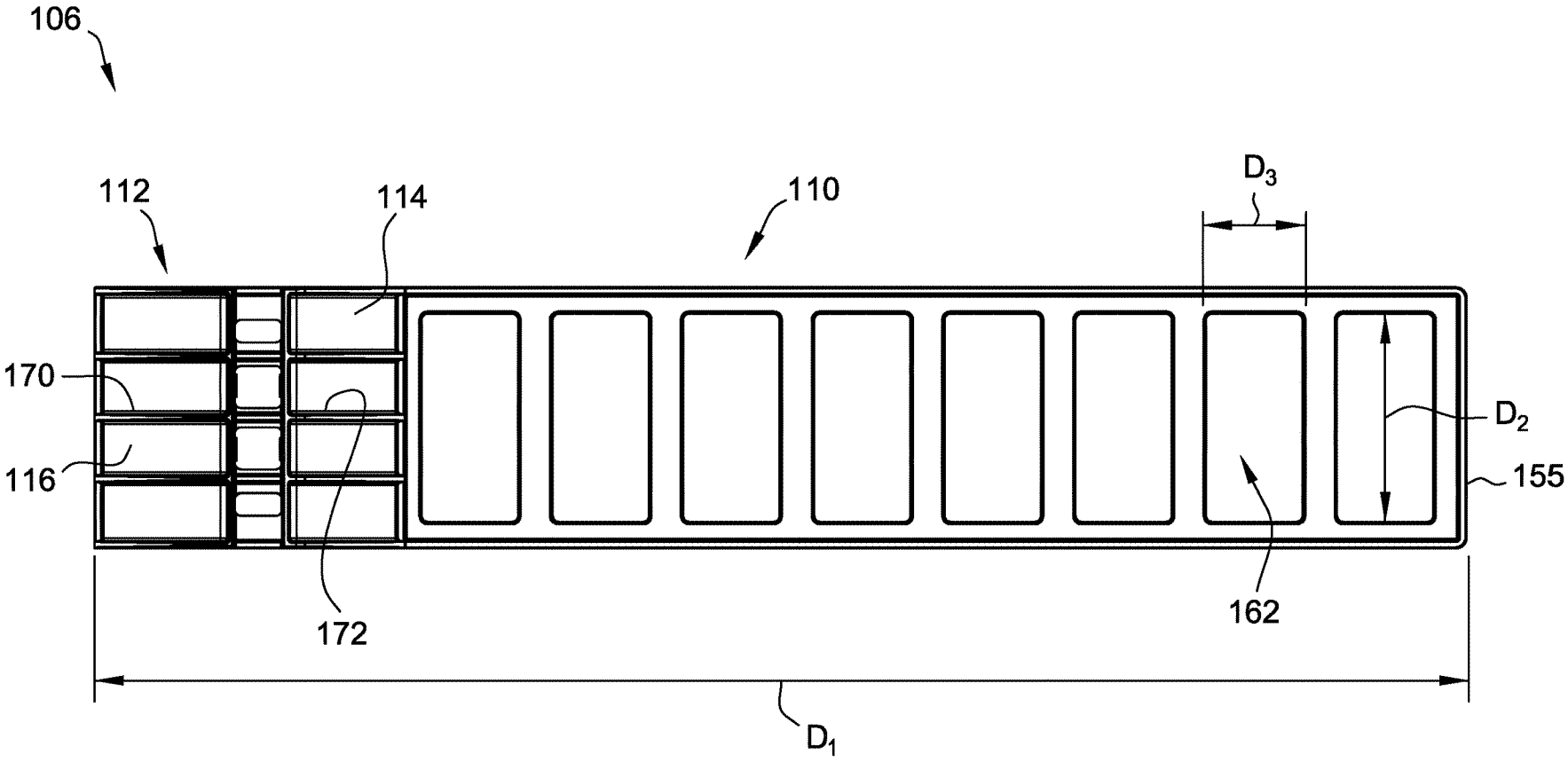
FIG. 11 is a top view of the support leg of FIG. 9.

With reference to FIG. 10, the front support 116 of the bracket 112 includes a front slot side wall 166 and the rear support 114 includes a rear slot side wall 168 facing the front slot side wall 166. The illustrated front slot side wall 166 has a height $R_1$ defined from the base 118 of the extension platform 110 to the upper extent of the front support 116. The rear slot side wall has a height $R_2$ defined from the base 118 of the extension platform 110 to the upper extent of the front support 116. In the illustrated embodiment, the height $R_1$ of the front slot side wall 166 is greater than the height $R_2$ of the rear slot side wall 168 to provide additional support to the face panel 102 (shown in FIG. 1) against the pressure of backfill material when the face panel 102 is received within the slot 120. In other embodiments, the height $R_1$ of the front slot side wall 166 is equal to the height $R_2$ of the rear slot side wall 168. In yet other embodiments the front slot side wall 166 is and the rear slot side wall 168 may be sized in any manner that enables the retaining wall system to function as described herein. The front slot sidewall 166 and the rear slot sidewall 168 extend in parallel to one another and are transversely oriented to the base 118. Accordingly, as best seen in FIG. 2, when the face panel 102 is received within the slot 120, the face panel 102 is supported transversely to the support leg 106 and extends upright creating the "L-shaped" configuration of the retaining wall system 100.

Figure 9:
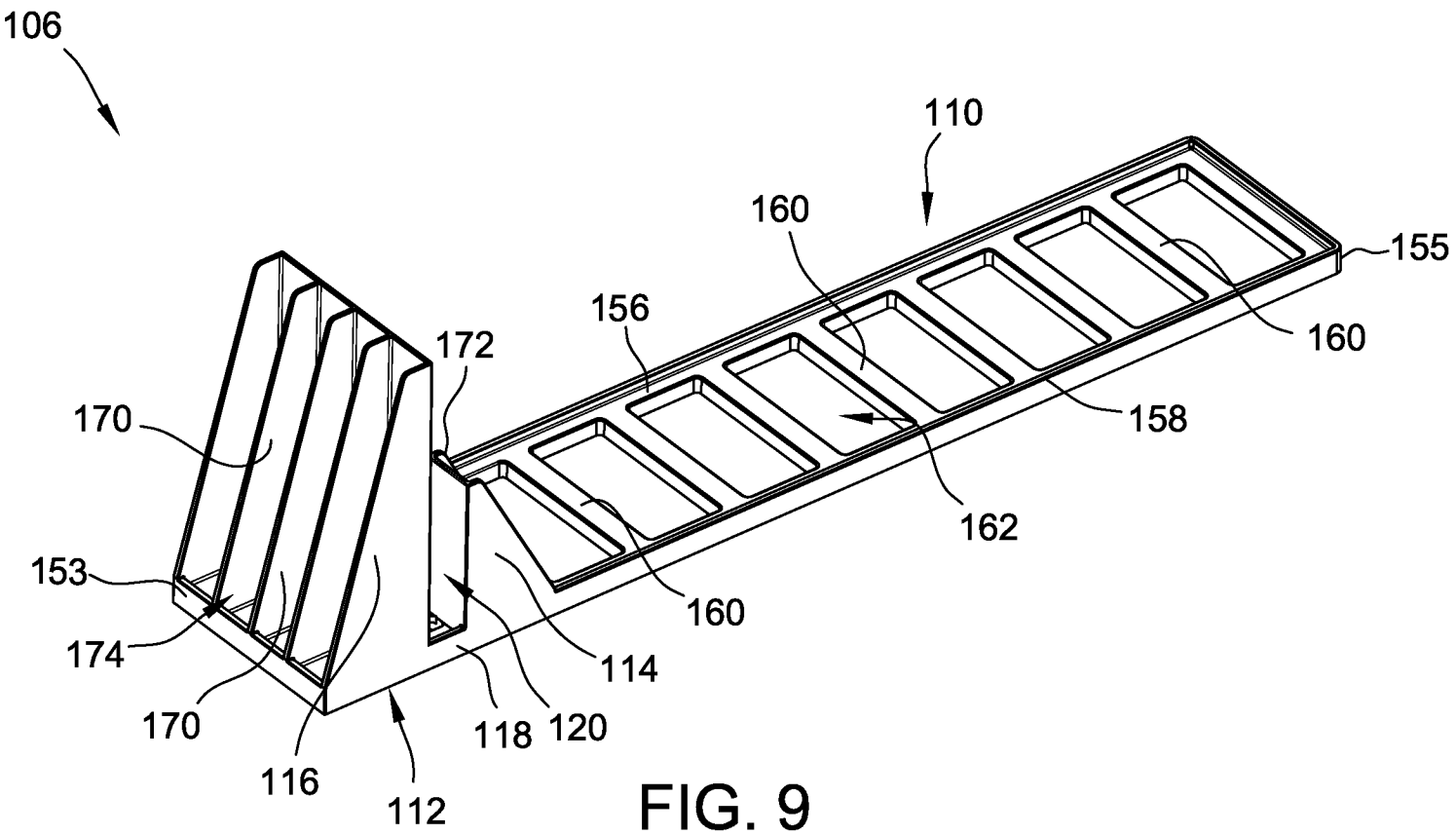
FIG. 9 is a perspective view of the support leg of retaining wall system of FIG. 1.
Figure 12:
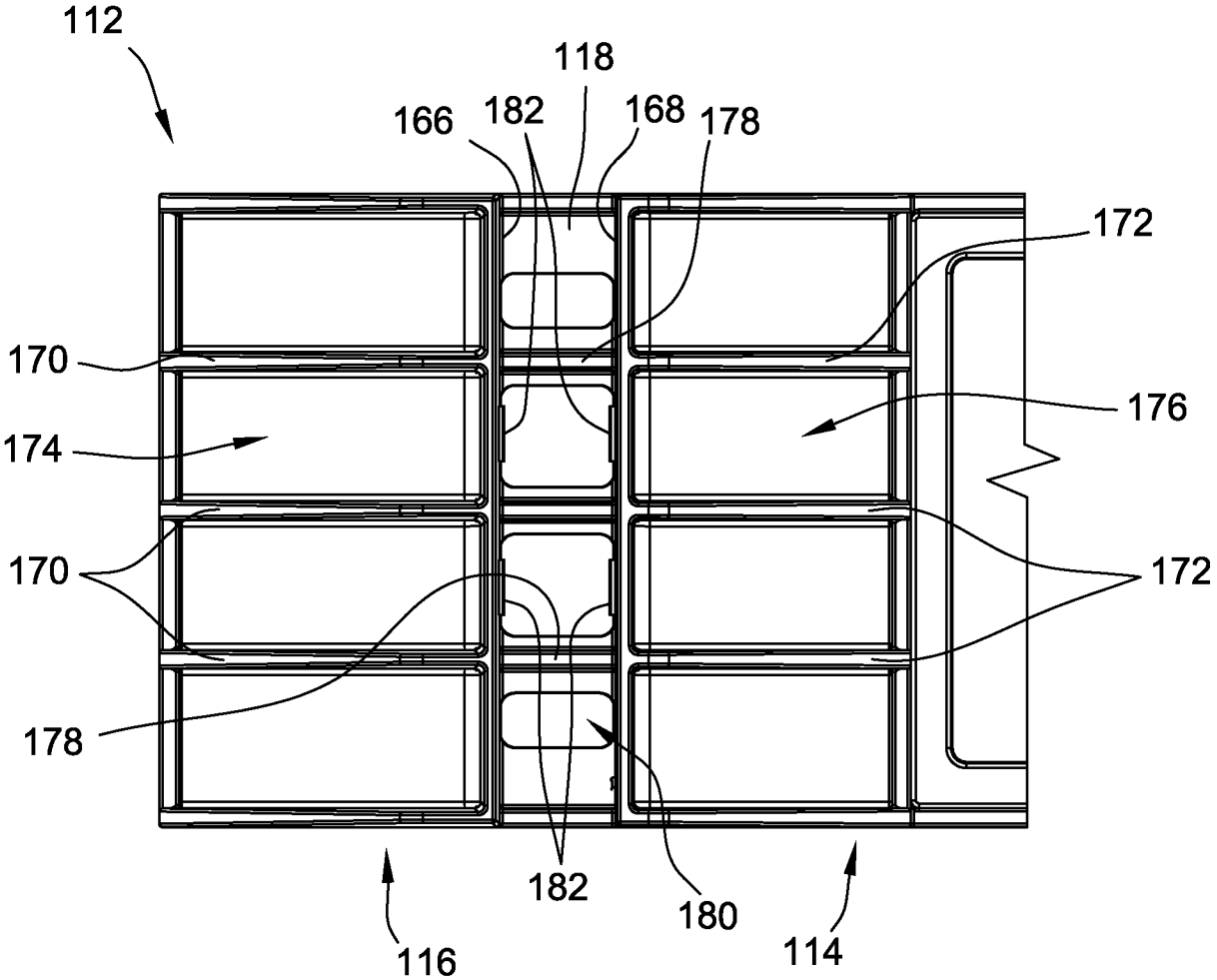
FIG. 12 is an enlarged, top view of the support leg of FIG. 9.

With reference to FIGS. 9 and 12, the illustrated support leg 106 further comprises a plurality of front fins 170 located on front support 116 of the bracket 112 and a plurality of rear fins 172 located on the rear support 114 of the bracket. The front fins 170 extend obliquely from the front end 153 of the front support 116 to the upper extent of the front support 116 of the bracket 112. The rear fins 172 extend obliquely from the base 118 proximate the extension platform 110 to an upper extent of the rear support 114.

Each of the front fins 170 is transversely spaced from one another to define front recesses 174 therebetween. In particular, each of the front recesses 174 are defined between the base 118, adjacent front fins 170, and the front slot sidewall 166. In other embodiments, ribs (not shown) may extend in recesses 174, 172 between fins 170. The front recesses 174 are configured to receive a backfill material or soil material therein to provide additional structural support to the retaining wall system 100. Likewise, the rear fins 172 also define rear recesses 176 between the base 118, adjacent rear fins 172, and the rear slot sidewall 168. The rear recesses 176 are configured to receive backfill material therein to provide additional structural support to the extension platform 110. More specifically, the recesses 174, 176 further anchor the extension platform 110 in backfill material or soil such that the extension platform 110 resists a tendency towards rotation of the extension platform 110 caused by the load of the backfill material against the face panel 102. In other embodiments, the recesses 174, 176 may be sealed from external soil and filled with any suitable filling material.

Referring to FIG. 12, the base 118 of the extension platform 110 includes cross bars 178 extending between the sidewalls 166, 168 and positioned in alignment with respective front fins 170 and rear fins 172. Further, the base 118 defines a plurality of apertures, indicated generally at 180, separated from one another by the cross bars 178. In the illustrated embodiment, the base 118 defines four apertures each positioned in lengthwise alignment with respective front and rear recesses 174, 176.

In the illustrated embodiment, flexibly resilient locking tabs 182 are located on the front slot sidewall 166 and the rear slot sidewall 168. The flexibly resilient locking tabs 182 are arranged to engage portions of the face panel 102 when the face panel 102 is positioned within the slot 120 (shown in FIG. 1) to prevent movement of the face panel 102 within the slot.

Figure 13:
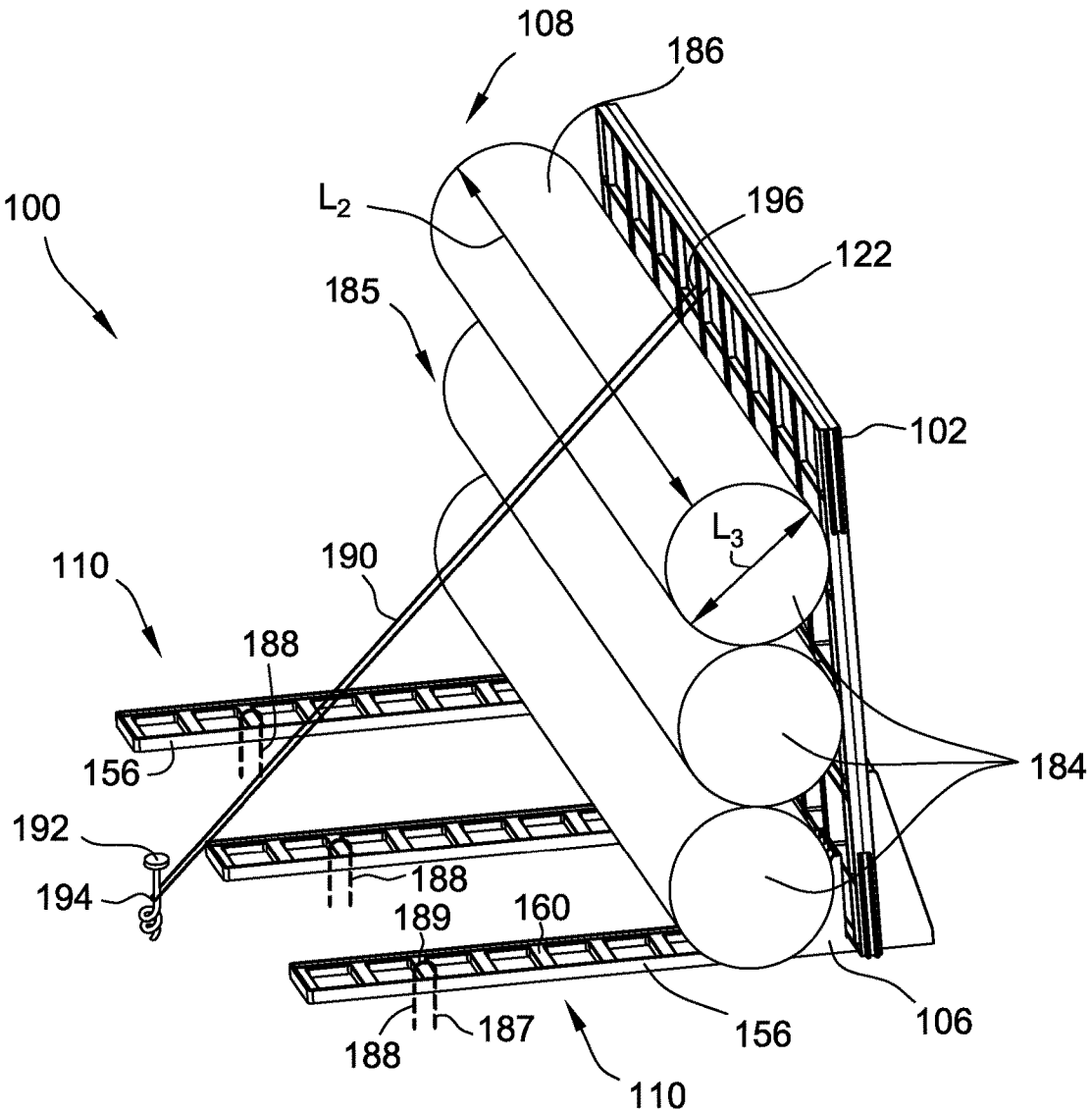
FIG. 13 is a perspective view of the retaining wall system of FIG. 1 including tubes of soil positioned against the face panel.

Referring to FIG. 13, the retaining wall system 100 of the present disclosure may also include a soil column, generally indicated at 185, located on the backfill side 108 of the retaining wall system 100 adjacent the first face panel 102. In the illustrated embodiment, the soil column 185 includes a plurality of soil tubes 184. In other embodiments, the soil column 185 may include loose soil stacked between the first face panel 102 and compacted backfill material (not shown) on the backfill side 108. In the illustrated embodiment, the soil tubes 184 are generally cylindrical in shape and include a length $L_2$ extending along the first face panel 102 of two feet and a diameter $L_3$ of five inches. In other embodiments, the soil tubes 184 may include a diameter $L_3$ of 8 inches. In yet further embodiments the soil tubes 184 may be sized in any manner that enables the retaining wall system 100 to function as described herein. In the illustrated embodiment, the soil tubes 184 are configured to act as a buffer between the backfill material (not shown) filled on the backfill side 108 and the first face panel 102. In particular, the soil tubes 184 buffer, absorb, and redirect at least some of the pressure from the backfill material to reduce the pressure applied on the first face panel 102 and thereby minimize deflection of the first face panel 102.

In the illustrated embodiment, the soil tubes 184 include an outer layer 186 formed of a water permeable material. In particular, the outer layer 186 of soil tubes allows water to permeate the soil tubes and provide irrigation to soil located within the outer layer 186. The outer layer 186 of the soil tubes 184 may be formed of a polymer mesh or paper material. In other embodiments, soil is positioned adjacent the first face panel 102 without an outer layer 186 (i.e., by laying fertile soil between backfill). In yet further embodiments, a filtration membrane, such as, for example, a fabric (similar to outer layer 186) may be attached to the first face panel 102 to filter and separate soil located on the backfill side 108 from the front side 109. The soil tubes 184 facilitate providing a precise volume and quality of soil adjacent the first face panel 102 to facilitate plant growth through the openings 144 (shown in FIG. 4) of the first face panel 102, thereby enabling a "living wall."

The retaining wall system 100 also may optionally include a plurality of soil anchors 188 as shown in the illustrated embodiment. The soil anchors 188 each engage a step bar 160 of the extension platform 110 and are configured to anchor the extension platforms 110 to compacted backfill material beneath the extension platforms. In the illustrated embodiment, the soil anchors 188 are each engaged with a step bar 160 located rearwardly on the extension platform 110. In other embodiments, the soil anchors 188 may be engaged with any step bar 160 of the support legs 106. Further, in some embodiments, multiple soil anchors 188 may be positioned on each extension platform 110 to provide additional anchoring of the support legs 106 within the backfill material. In the illustrated embodiment, the soil anchors 188 are staple shaped. That is, the soil anchors 188 include ends 187 extending below the extension platform 110 and a midsection 189 located between the ends 187. The midsection 189 is engaged with the step bar 160 to anchor the extension platform 110 in the compacted backfill material. In other embodiments, the soil anchors 188 may have any shape that enables the soil anchors 188 to function as described herein. For example, in other embodiments, the soil anchors 188 may be configured to engage the leg struts 156 of the extension platform 110. In yet other embodiments, the soil anchors 188 may be configured to engage a structural reinforcement geogrid (not shown) attached to the first face panel 102 and extending in parallel to the support legs 106.

The retaining wall system 100 of the present disclosure may also optionally include a restraint 190 connected to a restraint anchor 192, as shown in FIG. 13. In the illustrated embodiment, the restraint 190 is connected to the restraint anchor 192 at ends 194 and includes a middle section 196 looped around and engaged with the upper end beam 122 of the face panel 102. The restraint anchor 192 is configured to be fixedly planted within the compacted backfill material and provide a restraining force to the face panel 102 to inhibit outwardly deflection of the face panel 102 away from compacted backfill material on the backfill side 108. More specifically, the restraint 190 is configured to provide a force on the face panel 102 in a substantially opposite direction to the deflecting force provided on the face panel 102 by the backfill material located on the backfill side 108. In the illustrated embodiment, the retaining wall anchor 192 is planted in the compacted backfill material at the same layer which the support legs 106 are rested on and is located rearwardly of the support legs 106. In other embodiments, the retaining wall anchor 192 is planted in the backfill material as the backfill material is filled on the backfill side 108 above the support legs 106 to provide additional reinforcement to, and inhibit deflection of, the first face panel 102. In the illustrated embodiment, the retaining wall system 100 includes a single restraint 190 and restraint anchor 192. In other embodiments, the retaining wall system 100 may include any number of restraints 190 and restraint anchors 192 that enables the retaining wall system 100 to function as described herein.

Figure 14A:
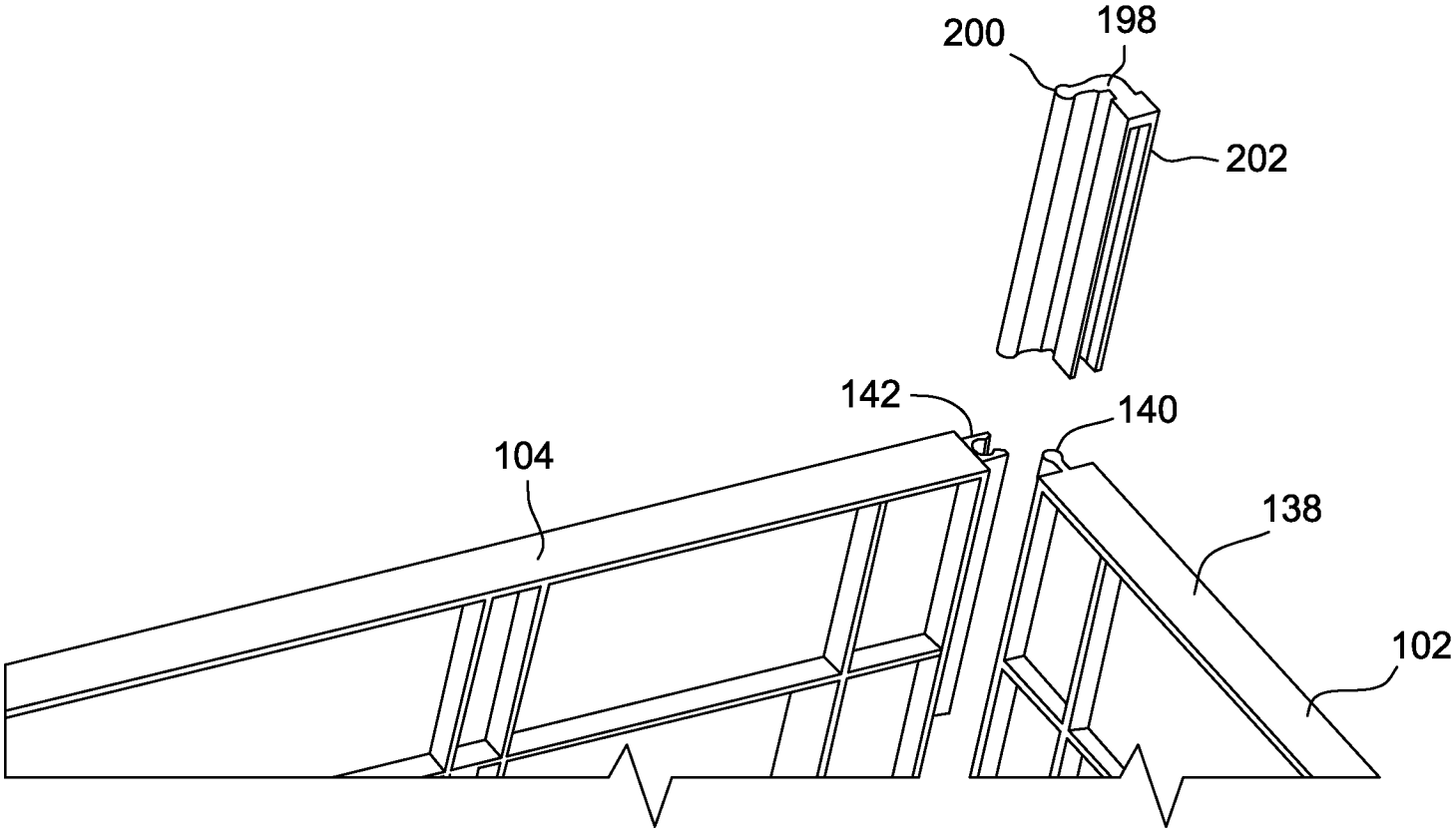
FIG. 14A is an enlarged, perspective view of a portion of the retaining wall system of FIG. 1 illustrating a connection accessory for use in the retaining wall system of FIG. 1 removed from the first face panel and second face panel.
Figure 14B:
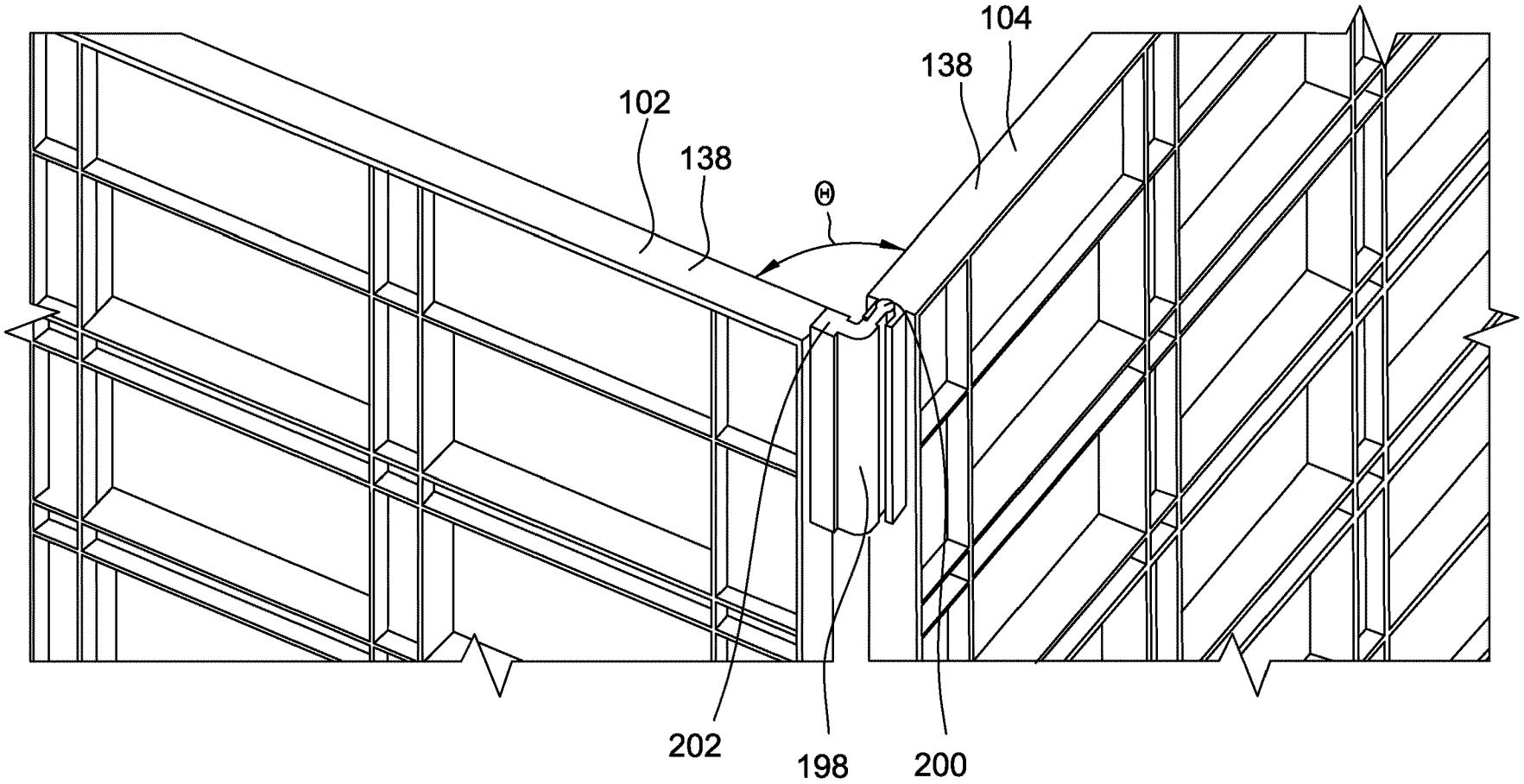
FIG. 14B is an enlarged, perspective view illustrating the connection accessory of FIG. 14A attached to the first face panel and the second face panel.

Referring to FIGS. 14A and 14B, a connection accessory 198 for use in the retaining wall system 100 is shown. The illustrated connection accessory 198 is independent from and selectively attachable to the first face panel 102 and the second face panel 104. The connection accessory 198 facilitates attaching the first face panel 102 to the second face panel 104 in a variety of angular configurations. For example, referring to FIG. 14B, in the illustrated embodiment, the first face panel 102 is attached to the second face panel 104 via the connection accessory 198 at an angle θ. In the illustrated embodiment, the angle θ is approximately 90 degrees. In other embodiments, the angle θ may be any suitable connection angle that enables the retaining wall system 100 to function as described herein. In the illustrated embodiment, the connection accessory 198 is formed of a resiliently flexible material such that the connection accessory 198 may be flexed to increase or decrease the angle θ of connection between the first face panel 102 and the second face panel 104. More particularly, in the illustrated embodiment, the connection accessory 198 is configured to flex such that the angle θ of connection between the first face panel 102 and the second face panel 104 may be between 45 degrees and 135 degrees. In other embodiments, the connection accessory 198 may be formed of a rigid material such that the connection accessory 198 inhibits flexing the first face panel 102 with respect to the second face panel 104 to increase or decrease the angle θ. In yet other embodiments, the connection accessory 198 may include a hinge (not shown) arranged to be intermediate the first face panel 102 and second face panel 104 when the connection accessory 198 is selectively attached to the panels 102, 104. In such embodiments, the hinge may allow for the first face panel 102 to be connected to the second face panel 104 at any suitable angle θ.

In the illustrated embodiment, the connection accessory 198 includes a first connection member 200 and a second connection member 202. The first connection member 200 is sized and shaped substantially similarly to the first connection member 140 of the first face panel 102 and the second connection member 202 is sized and shaped substantially similarly to the second connection member 142 of the second face panel 104, described above with respect to FIGS. 7A-8B. Accordingly, in the illustrated embodiment, the first connection member 200 is plug shaped and sized to be received within a recess defined by the second connection member 142 of the second face panel 104. Further, the second connection member 202 defines a recess sized and shaped to receive the first connection member 140 of the first face panel 102 therein.

Figure 15:
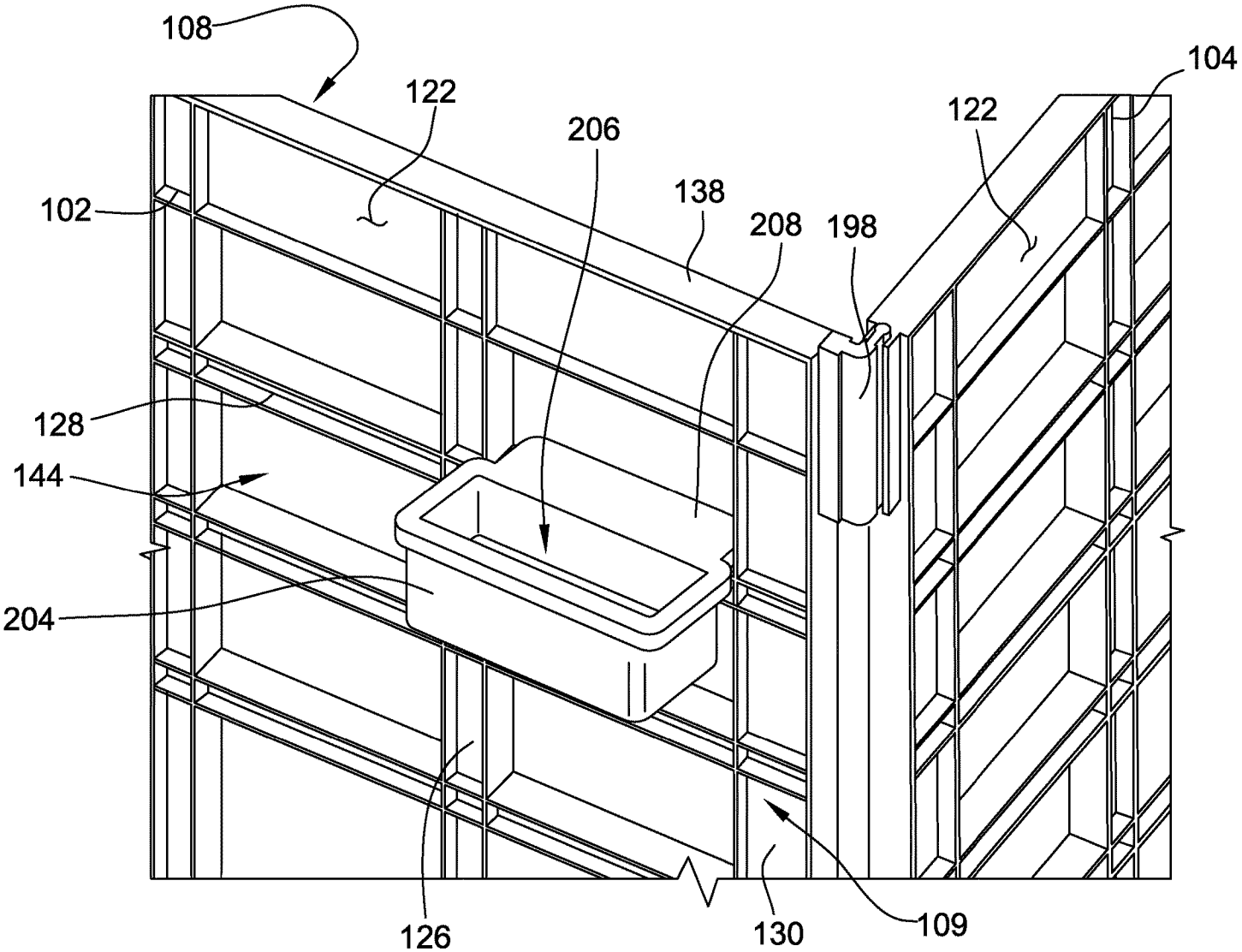
FIG. 15 is an enlarged, perspective view of a portion of the retaining wall system of FIG. 1 including a fluid retention accessory attached to the face panel.
Figure 16:
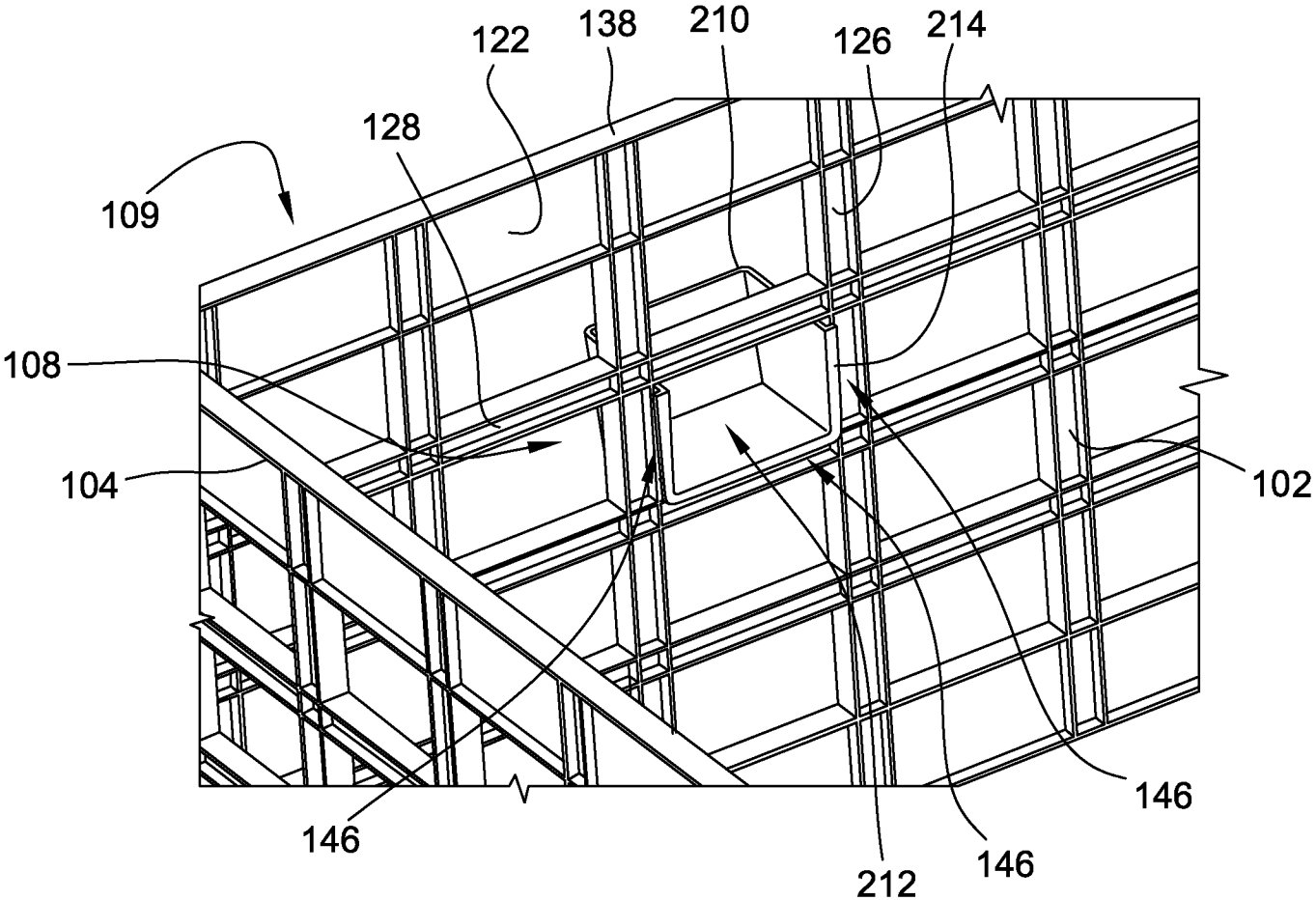
FIG. 16 is an enlarged, perspective view of a portion of the retaining wall system of FIG. 1 illustrating a soil retention accessory attached to the first face panel.

Referring to FIGS. 15 to 16, the face panels 102, 104 are configured to receive and support selectively attachable accessories thereon. For example, and not by way of limitation, the face panels 102, 104 may receive accessories configured to support plant life or greenery on the front side 109 of the retaining wall system 100 (e.g., a living wall). Furthermore, the face panels 102, 104 of the present disclosure may receive design accessories (not shown) configured to improve the aesthetic appearance of the face panels 102, 104. For example, and not by way of limitation, the face panels 102, 104 may receive selectively attachable aesthetic veneers (not shown) such as cultured stone, brick, wood, or aesthetic veneers of any other suitable material. In such embodiments, the aesthetic veneers are configured to cover openings 144. With particular reference to FIG. 15, the illustrated embodiment shows a fluid retention accessory 204 selectively attached to the first face panel 102. The fluid retention accessory 204 defines a reservoir, generally indicated at 206. The fluid retention accessory 206 is configured to receive and store fluid in the reservoir 206 for irrigating plant life and other greenery that may be desired to be grown on the front side 109 of the first face panel 102.

The fluid retention accessory 204 also includes a connection portion 208 extending between the reservoir 206 and the first face panel 102. The connection portion 208 is configured to selectively attach to the first face panel 102 and support the fluid retention accessory 204, including a load applied by fluid received within the reservoir 206. In the illustrated embodiment, the connection portion 208 is attached to the face panel 102 by frictional engagement between the connection portion 208 and the horizontally extending beam 128. More specifically, the connection portion 208 extends around the horizontally extending beam 128 from the front side 109 to the backfill side 108 and extends at least partially along the recess 146 (shown in FIG. 5) of the horizontally extending beam 128 such that the connection portion 208 attaches to the first face panel 102 in a snap-fit configuration. In other embodiments, the fluid retention accessory 206 is selectively attached to the first face panel 102 in any suitable manner that enables the fluid retention accessory 206 to function as described herein.

Referring to FIG. 16, a soil retention accessory 210 is shown connected to the first face panel 102. In the illustrated embodiment the soil retention accessory 210 partially defines an open reservoir, generally indicated at 212. That is, the reservoir 212 is in fluid communication with the backfill side 108. The soil retention accessory 210 is configured to receive and store soil in the reservoir 2012 for irrigating plant life and other greenery that may be desired to be grown on the front side 109 of the first face panel 102. In addition, the soil retention accessory 210 allows for soil to be provided through the reservoir 212 to the backfill side 108 to facilitate the growth of plant life from the backfill side 108, through the first face panel 102 and onto the front side 109.

The soil retention accessory 210 also includes a connection portion 214 extending between the reservoir 212 and the first face panel 102. The connection portion 214 is configured to selectively attach to the first face panel 102 and support the soil retention accessory 210, including a load applied by soil received within the reservoir 212. In the illustrated embodiment, the connection portion 214 is attached to the face panel 102 by frictional engagement between the connection portion 214 and the horizontally extending beam 128 and between the connection portion 218 and the vertically extending beams 126. More specifically, the connection portion 214 extends around the horizontally extending beam 128 and the vertically extending beams 126 from the front side 109 to the backfill side 108. The connection portion 218 further extends at least partially along the recesses 146 of the horizontally extending beam 128 and the vertically extending beams 126 such that the connection portion 208 attaches to the first face panel 102 in a snap-fit configuration. In other embodiments, the soil retention accessory 210 is selectively attached to the first face panel 102 in any suitable manner that enable the soil retention accessory 210 to function as described herein.

Figure 17:
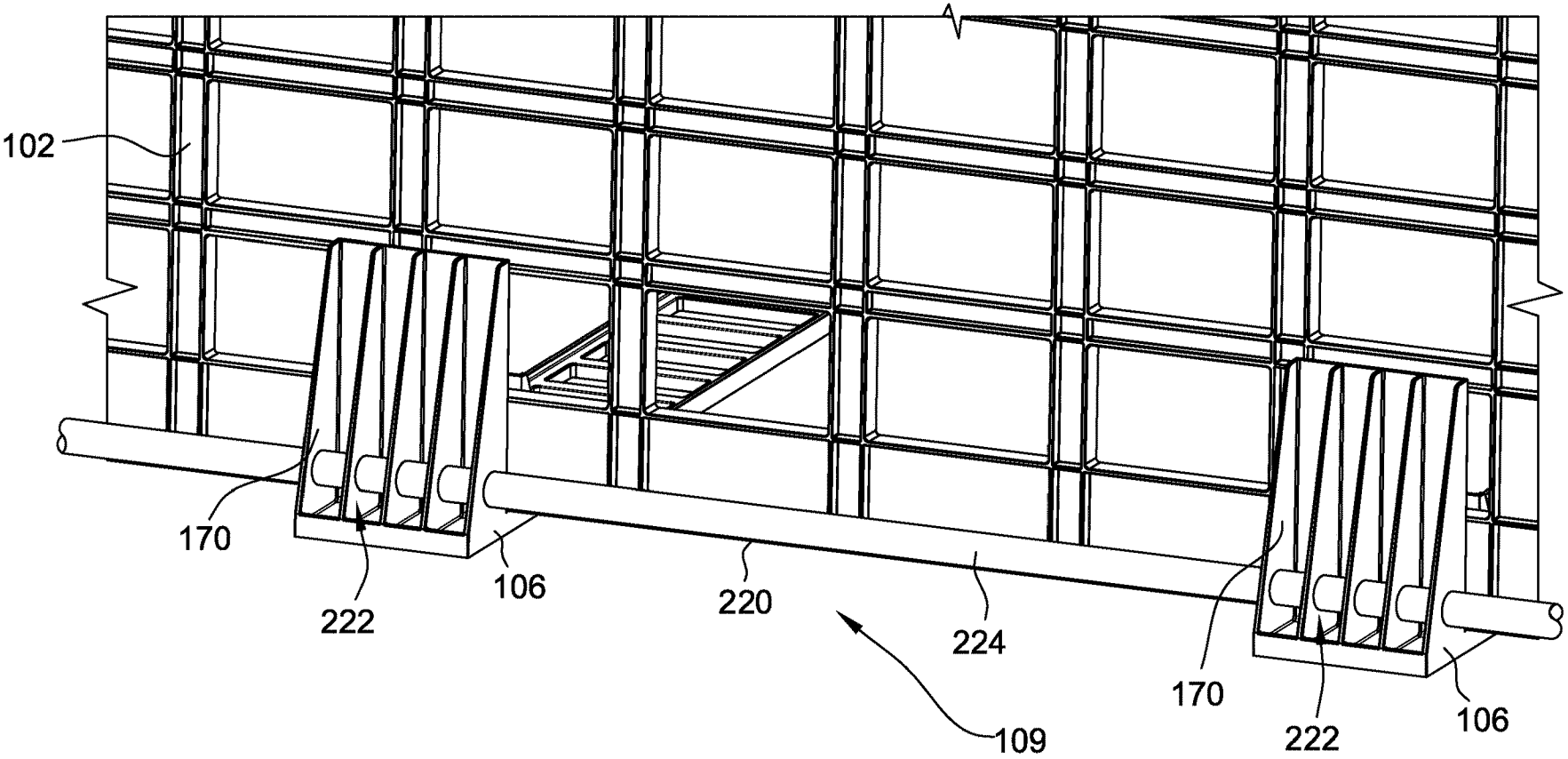
FIG. 17 is an enlarged, perspective view of a portion of the retaining wall system of FIG. 1 including a drip line and an alternate support leg having a plurality of apertures in the front support of the support leg receiving the drip line.
Figure 18:
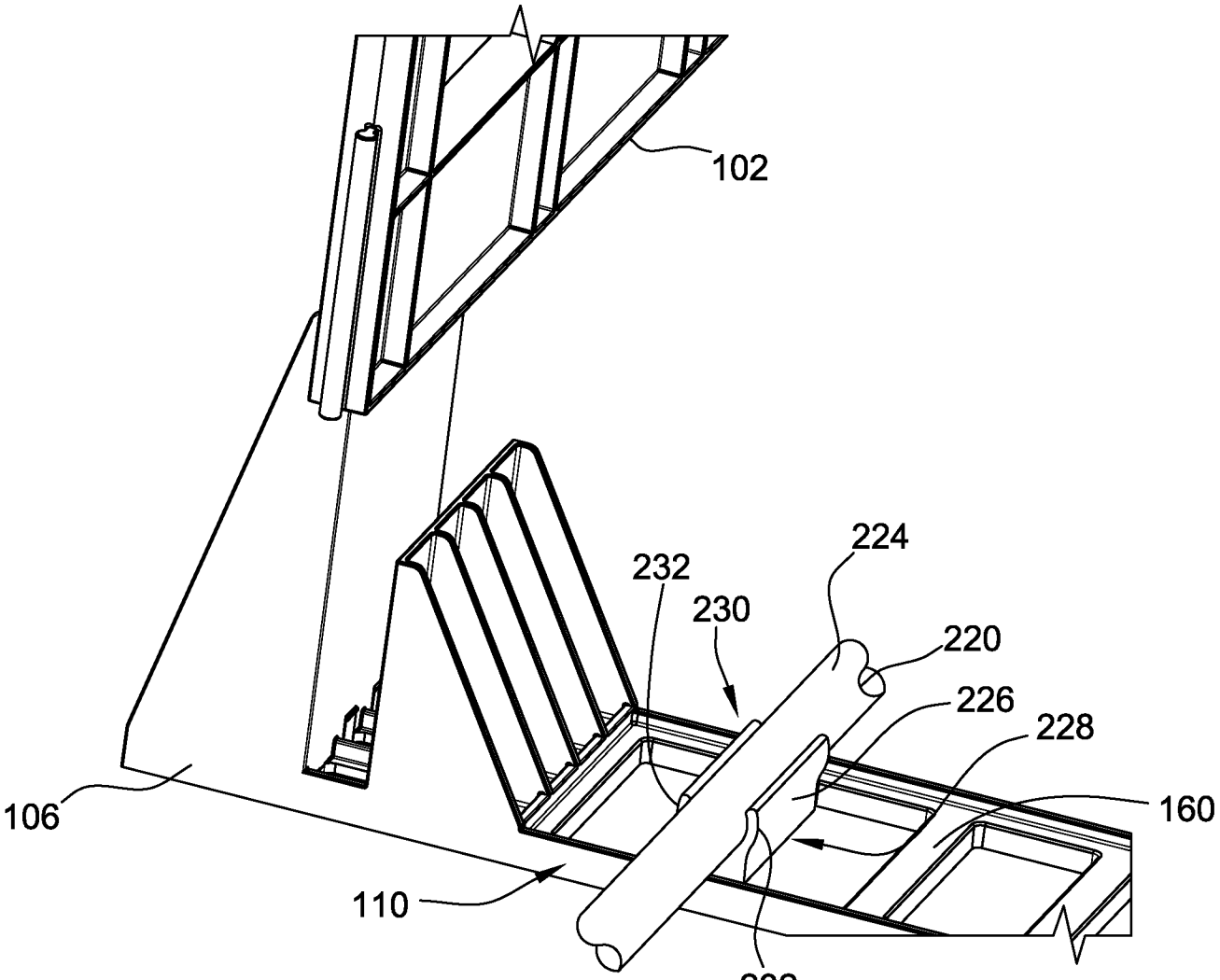
FIG. 18 is an enlarged, perspective view of a portion of the retaining wall system of FIG. 1 including a drip line and clip accessory on the extension platform of the support leg receiving the drip line.

Referring to FIGS. 17 and 18, the retaining wall system 100 of the present disclosure may optionally include a fluid transfer mechanism 220 for moving a fluid within the retaining wall system 100. For example, the fluid transfer mechanism 220 may be used to move water absorbed by soil within or adjacent the retaining wall system 100 away from the face panels 102, 104 to maintain the structural integrity of compacted backfill material or soil on the backfill side 108 or other material on the front side 109. In the illustrated embodiment, the fluid transfer mechanism 220 is a drip line. In other embodiments, the fluid transfer mechanism 220 may be any suitable device which enables the fluid transfer mechanism 220 to function as described herein.

With particular reference to FIG. 17, in the illustrated embodiment the fluid transfer mechanism 220 is shown as received in an alternate support leg 106 for use in the retaining wall system 100 of FIG. 1. The support leg 106 defines a plurality of apertures, indicated generally at 222, with an aperture 222 being defined within each front fin 170 of the support legs 106. In the illustrated embodiment, the fluid transfer mechanism 220 is located on the front side of the retaining wall system 100. The fluid transfer mechanism 220 is water permeable to facilitate fluid communication between an interior (not shown) of the fluid transfer mechanism 220 and the region surrounding the fluid transfer mechanism 220. For example, in the present embodiment, the fluid transfer mechanism 220 includes a plurality of apertures (not shown) defined in an outer surface 224 of the fluid transfer mechanism 220. As a result, the fluid transfer mechanism 220 may be configured to transport water collected in soil or other material located adjacent the front face panel 102 on the front side 109 of the retaining wall system 100 away from the retaining wall system 100. In some embodiments, the fluid transfer mechanism 220 may also include a barrier (not shown) covering the apertures to inhibit clogging of the apertures by surrounding soil or other material. The fluid transfer mechanism 220 may also be configured to provide fluid to soil or other material adjacent the retaining wall system 100. For example, and without limitation, the fluid transfer mechanism 220 may provide liquid water from a water source to plant life or other greenery growing on the front side 109 of the retaining wall system 100. For example, in such embodiments where the fluid transfer mechanism 220 is configured to provide water for irrigation purposes, locating the fluid transfer mechanism 220 within the front fins 170 of the support legs 106 allows for efficient irrigation of plant life or other greenery located at or below the level of soil on which the support leg 106 is rested.

Referring to FIG. 18, a clip accessory 226 is shown. The clip accessory 226 includes a first end, generally indicated at 228, for connecting to a component of the retaining wall system 100 and a second end, generally indicated at 230, for supporting the fluid transfer mechanism 220. In the illustrated embodiment, the clip accessory 226 is selectively attachable to the step bars 160 of the extension platform 110 at the second end 228. In other embodiments, the clips accessory 226 is selectively attachable to any other suitable component of the retaining wall system 100 that enables the clip accessory 226 to function as described herein. For example, and not by way of limitation, in other embodiments, the second end 228 of the clip accessory 226 is configured to be selectively attachable to the leg struts 156 of the support leg 106. In yet other embodiments, the second end 228 of the clip accessory 226 is configured to be selectively attached to one of the beams 126, 128 of the first face panel 102 to support the fluid transfer mechanism 220 at a height above the support leg 106.

In the illustrated embodiment, the first end 228 of the clip accessory 226 includes a pair of opposed resiliently flexible arms 232 connected to the second end 230 and configured to flex outwardly from one another when the fluid transfer mechanism 220 is inserted between the arms 232. The arms 232 are further configured to flex inward towards one another when a widest point of the fluid transfer mechanism 220 is received within the clip accessory 226 such that the arms 232 retain the fluid transfer mechanism 220 in a torsional snap fit. In other embodiments, the fluid transfer mechanism 220 is selectively attachable to the clip accessory 226 in any manner that enables the clip accessory 226 to function as described herein.

Figure 20:
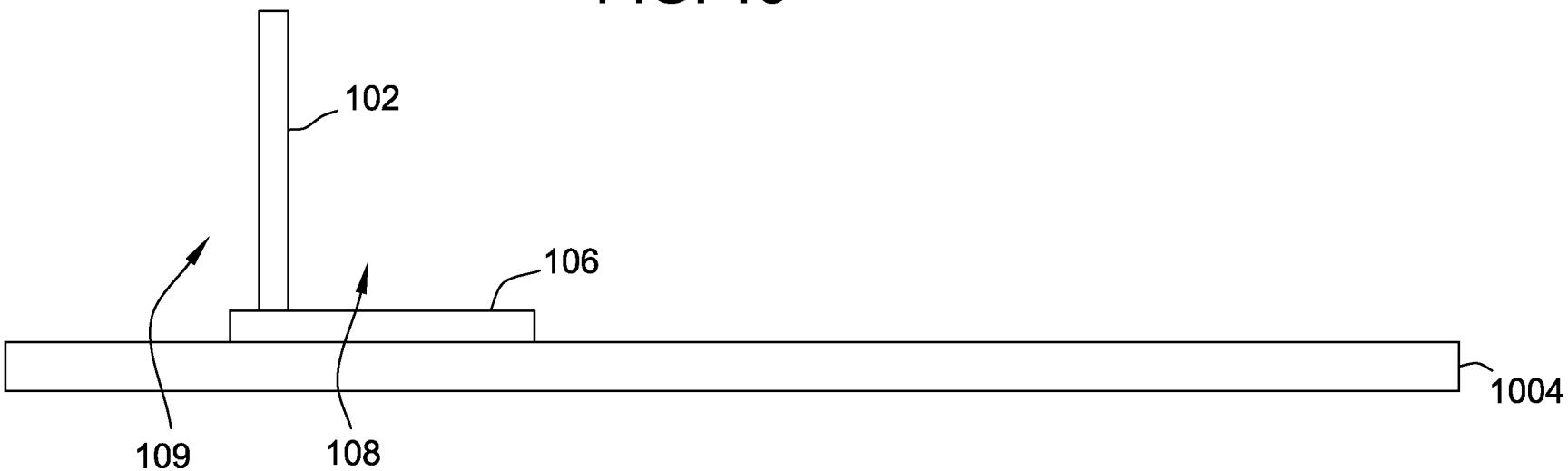
FIG. 20 illustrates a second state of the process of FIG. 19, wherein the first face panel and the support leg are provided.

With reference to FIGS. 19-25, a process of constructing one suitable embodiment of the retaining wall system 100 of the present disclosure is shown. In FIG. 19, an area of land, indicated generally at 1000, for constructing the retaining wall is identified. The land 1000 includes a layer of top soil 1002 and a layer of subsoil 1004 beneath the top soil layer 1002. The top soil layer 1002 may optionally be removed before constructing the retaining wall, as shown in FIG. 20. Next, an area for placing the retaining wall system 100 is identified. The first face panel 102 is connected to the support leg 106 and may then be positioned in the upright position on top of the subsoil layer 1004. Alternatively, the first face panel 102 may be inserted into the support leg 106 before standing up the first face panel 102 (e.g., inserting the first face panel 102 into the support leg with the support leg 106 rotated transversely).

Figure 21:
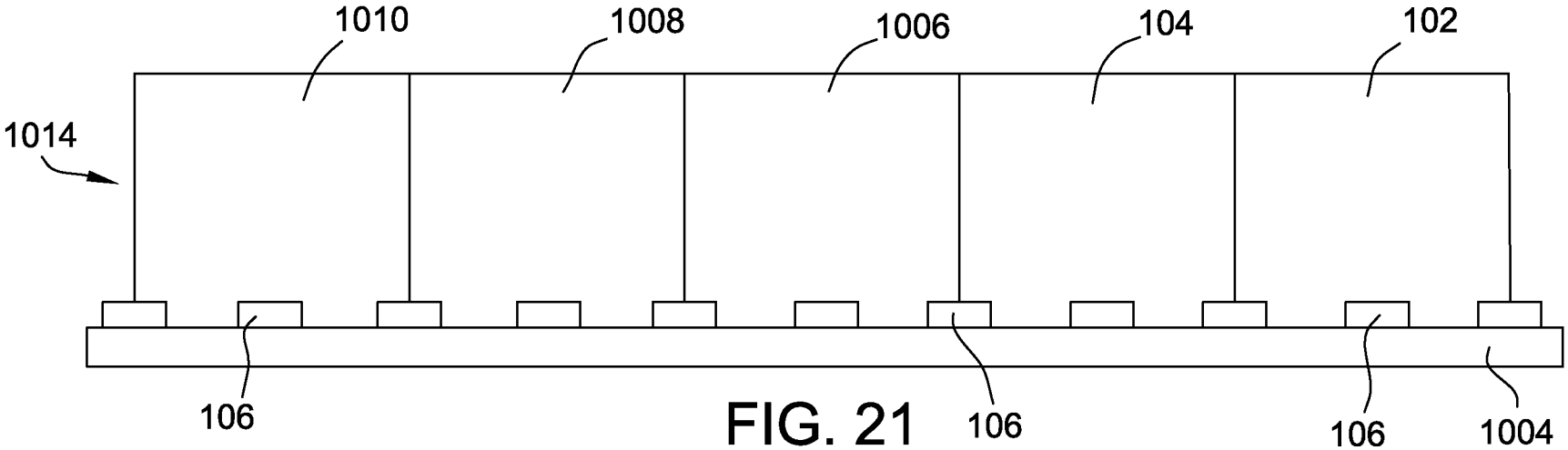
FIG. 21 illustrates a third state of the process of FIG. 19, wherein a plurality of face panels are attached to the first face panel.

Referring to FIG. 21, additional support legs 106 are positioned substantially equidistant from adjacent support legs 106 based on a determined level of support desired for the retaining wall system 100 and the desired number of face panels. In the illustrated embodiment, a desired number of face panels 102, 104, 1006, 1008, 1010 are then positioned within the support legs 106 to define a first panel layer, indicated generally at 1014, of the retaining wall system 100. The number of face panels 102, 104, 1006, 1008, 1010 of the retaining wall system 100 is determined based on the total area to be retained. For example, and not by way of limitation, in the illustrated embodiment, the first panel layer 1014 includes five face panels 102, 104, 1006, 1008, 1010. In other embodiments, the first panel layer 1014 includes any number of face panels 102, 104, 1006, 1008, 1010 that enables the retaining wall system 100 to function as described herein. In the illustrated embodiment, after the face panels 102, 104, 1006, 1008, 1010 are received within the support legs 106, the face panels 102, 104, 1006, 1008, 1010 are each connected to adjacent face panels via the connection members 140, 142 (shown in FIGS. 7A-8B).

Figure 22:
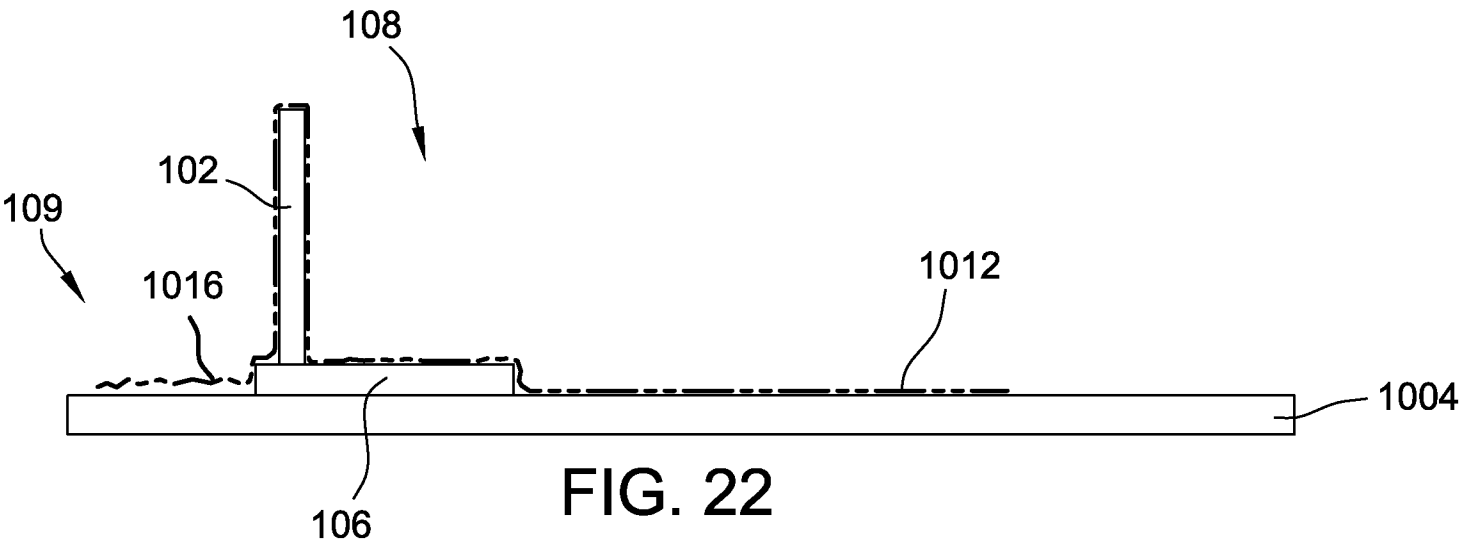
FIG. 22 illustrates a fourth state of the process of FIG. 19, wherein a geogrid is provided.

With reference to FIG. 22, after the face panels 102, 104, 1006, 1008, 1010 are connected to one another, a structural reinforcement geogrid 1012 is laid on the backfill side 108 of the retaining wall system 100. The geogrid 1012 may be formed of any suitable polymer material and is configured to transfer a load applied on the face panels 102, 104, 1006, 1008, 1010 from compacted backfill material to an area of soil resting on the geogrid 1012. In other embodiments, the geogrid 1012 is any suitable soil reinforcement, such as, for example geotextile, geo-straps, soil fibers, chemical/cement/biologically stabilized soil materials, as well as steel straps, mesh, ladders, or structural sections. In the illustrated embodiment, the geogrid 1012 is sized to extend along the subsoil 1004 on the backfill side 108, along the face panel 102, and include an excess portion 1016 draped over the front side 109. In other embodiments, the geogrid 1012 is sized a shorter length to extend along the subsoil 1004 on the backfill side 108 to the support legs 106. In such embodiments, a separate structural support material (not shown) may also be wrapped around the face panel 102. In even further embodiments, the geogrid 1012 is sized to have any suitable length that enables the retaining wall system 100 to function as described herein.

Referring to FIGS. 23 and 24, after the geogrid 1012 is installed, a backfill material, generally indicated at 1018 is laid on top of the geogrid 1012 and is distributed substantially evenly along the backfill side 109. In other embodiments, soil or soil tubes 184, may be located adjacent the first face panel 102, for example, between the geogrid 1012 and the first face panel 102 to facilitate providing a living wall. With particular reference to FIG. 23, once an initial layer of backfill material 1018 is laid, an operator compacts the backfill material 1018 by passing over the material with a compactor. The backfill material 1018 is compacted for each layer added to the retaining wall system. This process of adding backfill material 1018 and compacting the added backfill material is repeated until the height of the backfill material 1018 is substantially near the top of face panels 102, 104, 1006, 1008, 1010. Notably, in the illustrated embodiment, the retaining wall system 100 does not include obstructions extending from the top of the face panels 102, 104, 1006, 1008, 1010 downward near the end of the support legs 106. Accordingly, in the illustrated embodiment, the operator is able to make unobstructed passes over the backfill material 1018. That is, the operator does not need to navigate the compactor around obstructing components of the retaining wall system 100 when compacting the backfill material 1018.

Referring to FIG. 24, once the backfill material is filled to the top of the face panels 102, 104, 1006, 1008, 1010, the excess portion 1016 of geogrid 1012 is draped back over the backfill material 1018, thereby providing added reinforcement for additional layers of backfill material 1018 that is added to the retaining wall system 100. With reference to FIG. 25, a first face panel 102 is then positioned within a support leg 106 and located directly on top of the excess portion 1016 of geogrid 1012 (shown in FIG. 24) at above or near the top of the first panel layer 1014. Additional face panels (not shown) are then connected to the first face panel 102 to form a second panel layer, generally indicated at 1020. In the illustrated embodiment, the second panel layer 1020 is horizontally offset from the first panel layer 1014 a distance O1. In other embodiments, the second panel layer 1020 is positioned in vertical alignment with the first panel layer 1014. The construction process described above in FIGS. 19-24 is then iterated to provide additional layers of backfill material 1018. More particularly, in the illustrated embodiment, the retaining wall system 100 includes three panel layers 1014, 1020, 1022. In other embodiments, the retaining wall system 100 may include any suitable number of panel layers 1014, 1020, 1022 that enables the retaining wall system to function as described herein.

As described above, embodiments of the retaining wall system include a modular polymer face panel and a support leg configured to be removably attached to the face panel. The configuration of the support leg and the face panel provides support to prevent deflection of the face panel without obstructing the placement of reinforcement geogrid or compacting of backfill. The face panels of above described embodiments also allow for simple removable connection of additional face panels and support legs to the retaining wall system. Accordingly, the retaining wall system improves the ease of use during construction of the retaining wall and improves construction sequence economy as well as labor and handling efficiency. Furthermore, embodiments of the retaining wall system include a face panel composed of a polymer or, more broadly, a non-ferrous metal material. Accordingly, the retaining wall system is relatively inexpensive compared with known face forms comprised of ferrous metals or cementitious materials used for retaining wall systems.

When introducing elements of the present invention or the preferred embodiment(s) thereof, the articles "a", "an", "the", and "said" are intended to mean that there are one or more of the elements. The terms "comprising," "including", and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

What is claimed is:

1. A retaining wall system comprising:

a face panel comprising a first end beam and a second end beam extending in parallel to the first end beam, the face panel extending a height defined from the first end beam to the second end beam when the face panel is oriented in an upright position, the face panel further comprising a front side and an opposed backfill side, wherein the face panel defines a plurality of openings extending through the face panel from the front side to the backfill side, the face panel further comprising a first side beam and a second side beam extending in parallel to the first side beam, the first side beam and the second side beam being transversely oriented with respect to both the first end beam and the second end beam, wherein the first side beam includes a first connection member and the second side beam includes a second connection member, and wherein the first and second connection members are configured to selectively attach the face panel with an additional face panel; and a support leg comprising a first end, a second end spaced from the first end to define a length of the support leg, and a base extending the length of the support leg for positioning the support leg on a ground surface, the support leg further comprising a bracket for receiving the first end beam therein and an extension platform transversely oriented to the height of the face panel when the first end beam is received within the bracket and extending away from the bracket to the second end, the extension platform configured to anchor the face panel in the upright position with the backfill side oriented to face a backfill material.

2. The retaining wall system of claim 1, wherein the bracket comprises a rear support and a front support, wherein a portion of the base extends between the rear support and the front support.

3. The retaining wall system of claim 2, wherein the front support has a height greater than or equal to the rear support.

4. The retaining wall system of claim 1, wherein the face panel is formed of an injection molded plastic.

5. The retaining wall system of claim 1, wherein the face panel further comprises a plurality of vertically extending beams and a plurality of horizontally extending beams arranged to intersect one another in a grid formation, and wherein a first opening of the plurality of openings is defined by a first vertically extending beam and a second vertically extending beam of the plurality of vertically extending beams, the first opening being further defined by a first horizontally extending beam and a second horizontally extending beam of the plurality of horizontally extending beams.

6. The retaining wall system of claim 1, wherein the first connection member is sized and shaped to be selectively attached to the second connection member.

7. The retaining wall system of claim 1 further comprising a connection accessory including a first connection member and a second connection member, wherein the first connection member of the connection accessory is similarly sized and shaped to the first connection member of the first side beam and the second connection member of the connection accessory is similarly sized and shaped to the second connection member of the second side beam.

8. The retaining wall system of claim 1, wherein the extension platform comprises a first strut and a second strut each extending in parallel away from the bracket, the extension platform further comprising a plurality of step bars transversely oriented to the struts and extending between the first strut and the second strut.

9. The retaining wall system of claim 1, wherein each opening of the plurality of openings is sized to facilitate plant growth through the openings from the backfill side to the front side of the face panel.

10. The retaining wall system of claim 1 further comprising a plurality of soil tubes configured to abut the backfill side, wherein each opening of the plurality of openings is sized to enable plant growth from the soil tubes to extend through the openings from the backfill side to the front side of the face panel.

11. The retaining wall system of claim 1, wherein the plurality of openings includes a first opening and the face panel does not include a wall positioned between the front side and the backfill side covering the first opening.

12. A retaining wall system comprising:

a face panel comprising a first end beam and a second end beam at a free distal end of the face panel, the second end beam extending in parallel to the first end beam, the face panel further comprising a front side and an opposed backfill side, wherein the face panel defines a plurality of openings extending through the face panel from the front side to the backfill side;

a mesh reinforcement configured to retain a backfill material on the backfill side; and a support leg selectively attachable to the first end beam, the support leg including a first end, a second end spaced from the first end to define a length of the support leg, and a base extending the length of the support leg in transverse orientation to the first and second end beams and positioned to receive the backfill material on at least a portion of the base, wherein the support leg is configured to support the face panel such that the second end beam is maintained in substantially parallel orientation with the first end beam.

13. The retaining wall system of claim 12, wherein the support leg comprises a bracket for receiving the first end beam therein, the support leg further comprising an extension platform transversely oriented to the height of the face panel when the first end beam is received within the bracket and extending away from the bracket.

14. The retaining wall system of claim 13, wherein the bracket comprises a rear support and a front support, wherein a portion of the base extends between the rear support and the front support.

15. The retaining wall system of claim 12, wherein the face panel is formed of an injection molded plastic.

16. The retaining wall system of claim 12, wherein the face panel further comprises a plurality of vertically extending beams and a plurality of horizontally extending beams arranged to intersect one another in a grid formation, wherein a first opening of the plurality of openings is defined by a first vertically extending beam and a second vertically extending beam of the plurality of vertically extending beams, the first opening being further defined by a first horizontally extending beam and a second horizontally extending beam of the plurality of horizontally extending beams.

17. The retaining wall system of claim 12, wherein the face panel further comprises a first side beam and a second side beam extending in parallel to the first side beam and transversely oriented with respect to the end beams.

18. The retaining wall system of claim 17, wherein the first side beam includes a first connection member and the second side beam includes a second connection member, wherein the first and second connection members are configured to selectively attach the face panel with an additional face panel.

19. A method of assembling a retaining wall, the method comprising:

providing a face panel including a first end beam and a second end beam extending in parallel to the first end beam, the face panel further including a front side and an opposed backfill side, the face panel defining a plurality of openings extending through the face panel from the front side to the backfill side;

attaching the first end beam of the face panel to a support leg such that the face panel extends a height from the first end beam to the second end beam, the support leg including an extension platform, a first end, a second end spaced from the first end to define a length of the support leg, and a base extending the length of the support leg;

positioning the base on a ground surface such that the extension platform extends into a backfill region;

positioning a mesh reinforcement on the backfill side of the face panel; and providing a backfill material on top of the extension platform such that the face panel and the mesh reinforcement retain the backfill material in the backfill region, the backfill material extending the height of the face panel.

* * * * *